US005649425A

United States Patent [19]

Matsumura et al.

[11] Patent Number: 5,649,425

[45] Date of Patent: Jul. 22, 1997

[54] TURBOEXPANDER PUMP UNIT

[75] Inventors: Masao Matsumura, Kanagawa-ken; Takao Takeuchi, Tokyo; Seigo Katsuta, Kanagawa-ken, all of Japan

[73] Assignee: Ebara Corporation, Tokyo, Japan

[21] Appl. No.: 391,762

[22] Filed: Feb. 21, 1995

[30] Foreign Application Priority Data

| | | | |
|---|---|---|---|
| Feb. 23, 1994 | [JP] | Japan | 6-025242 |
| May 30, 1994 | [JP] | Japan | 6-139535 |
| May 30, 1994 | [JP] | Japan | 6-139536 |
| Jul. 27, 1994 | [JP] | Japan | 6-194904 |
| Sep. 8, 1994 | [JP] | Japan | 6-242049 |

[51] Int. Cl.[6] ..... F01K 25/10

[52] U.S. Cl. ..... 60/648; 60/651; 60/671

[58] Field of Search ..... 60/648, 651, 671; 415/76, 93, 98, 99, 100, 144; 417/244, 245

[56] References Cited

U.S. PATENT DOCUMENTS

| | | | |
|---|---|---|---|
| 3,614,255 | 10/1971 | Rooney | 415/93 |
| 4,178,761 | 12/1979 | Schwartzman | 60/648 |
| 4,753,571 | 6/1988 | Schill et al. | 415/144 |
| 4,865,529 | 9/1989 | Sutton et al. . | |

OTHER PUBLICATIONS

"Design of an Oxygen Turbopump for use in an Advanced Expander Test Bed Engine", Pattison et al., American Institute of Aeronautics and Astronautics, Inc., 1993, pp. 1–7.

"Cryogenic Turboexpanders with Magnetic Bearings", Reuter et al., Cryogenic Processes and Machinery, No. 294, vol. 89, pp. 35–45.

*Primary Examiner*—Denise L. Ferensic
*Assistant Examiner*—Alfred Basichas
*Attorney, Agent, or Firm*—Armstrong, Westerman, Hattori, McLeland, & Naughton

[57] ABSTRACT

A turboexpander pump unit has a vertical or horizontal shaft, a pump connected to an end of the shaft for pressurizing a liquid fluid to a pressure higher than a predetermined delivery pressure, a heat exchanger for heating and converting the liquid fluid pressurized by the pump into a high-pressure gas, and an expander turbine connected to an opposite end of the shaft and actuatable by a thermal energy reduction produced when the high-pressure gas from the heat exchanger is lowered to the predetermined delivery pressure, for delivering the liquid fluid continuously under a predetermined pressure to an external installation. The pump having at least two outlet ports for discharging the liquid fluid at respective different pressures. One of the two outlet ports is connected to the heat exchanger, and the other to a liquid delivery line.

17 Claims, 19 Drawing Sheets

| | | $V_1$ | $V_2$ | $V_3$ | $V_4$ | $V_5$ | $V_6$ | $V_7$ |
|---|---|---|---|---|---|---|---|---|
| START | | O | O | C | O | C | C | O |
| | | | | | | | | |
| NORMAL OPERATION | | C | O | C | C | C | O | O |
| | | | | | | | | |
| | | | | | | | | |
| SPEED CONTROL | TO INCREASE SPEED | C | INCREASE OPENING | C | C | C | INCREASE OPENING | INCREASE OPENING |
| | TO LOWER SPEED | C | REDUCE OPENING | C/O | C | C | REDUCE OPENING | REDUCE OPENING |
| | | | | | | | | |

| | | $V_1$ | $V_2$ | $V_3$ | $V_4$ | $V_5$ | $V_6$ | $V_7$ |
|---|---|---|---|---|---|---|---|---|
| START | | O | O | C | O | O | C | O |
| | | | | | | | | |
| NORMAL OPERATION | | C | O | C | O | C | C | O |
| | | | | | | | | |
| | | | | | | | | |
| SPEED CONTROL | TO INCREASE SPEED | C | INCREASE OPENING | C | INCREASE OPENING | C | C | INCREASE OPENING |
| | TO LOWER SPEED | C | REDUCE OPENING | C/O | REDUCE OPENING | C | C | REDUCE OPENING |
| | | | | | | | | |

TURBOEXPANDER PUMP UNIT

BACKGROUND OF THE INVENTION

1. Field of the Invention

The present invention relates to a turboexpander pump unit, and more particularly to a turboexpander pump unit for use in a liquefied gas supply installation suitable for use in storing, transporting, and supplying a cryogenic liquid fuel such as a liquefied natural gas (LNG) or the like.

2. Description of the Prior Art

FIG. 19 of the accompanying drawings shows the concept of a conventional liquefied gas supply installation in an LNG base. An LNG unloaded from a transport ship is stored in a partly underground tank 201. The LNG stored in the tank 201 can be lifted by a primary (first stage) pump 202 immersed in the stored LNG. A portion of the LNG lifted out of the tank 201 is gasified by an evaporator 203 and delivered as a fuel for a boiler or a gas turbine in the LNG base. The evaporator 203 introduces seawater or waste hot water from an inlet 203A and discharges it from an outlet 203B, during which time the LNG is gasified by a heat exchange in the evaporator 203. Most of the LNG lifted by the pump 202 is pressurized by a secondary (second stage) pump 204, and either supplied in a liquid state to another LNG base through a pipeline 205 or subsequently gasified with heat by a heat exchanger (not shown) and delivered under pressure as a gas for generating electric energy or a city gas to a region where it is to be consumed.

The pump for pressuring the ultra low temperature LNG is generally in the form of a multistage vertical centrifugal pump, and is of the submerged type in which a pump and a motor for driving the pump are entirely submerged in the LNG to eliminate the possibility of leakage from sealed shaft portions (for details, see "Operation and control of LNG devices" written by Aizawa and Kubota, TURBOMACHINES, vol. 17, No. 5, pages 8–13).

Recent years have seen growing demands for LNG as a clean energy source suitable for environmental protection, and increasing LNG service areas have required liquefied gas supply devices to have a larger capacity, a greater scale, and a more ability to handle a higher gas pressure. The secondary pump 204 which is a main pump for delivering the LNG under pressure is, therefore, required to handle a greater gas flow rate and a higher head, and to be driven by a larger horsepower. A motor for driving the pump 204 needs a high-voltage electric energy supply installation having a large power capacity ranging from several hundreds to several tens of thousands kW, and, as a result, also needs a large electric energy transmission and distribution installation for transmitting and distributing electric energy to the motor.

As the number of stages and the size of the pump increase, an installation space and a maintenance procedure required by the pump pose problems. It has been customary to transport the LNG through a long pipe to a remote electric power generating station to generate electric energy, and supply the generated electric energy from the electric power generating station through long electric cables to the LNG pressure-delivery pump in the LNG base where the supplied electric energy is supplied to energize the motor. Such an electric energy supply system is not preferable from the standpoint of energy saving efforts. Stated otherwise, the supply of electric energy to the LNG pressure-delivery pump in the LNG base has resulted in a transport loss caused by the delivery of the LNG in a gas or liquid state to the electric power generating station, an energy conversion loss caused in the electric power generating station, a transport loss caused by the electric cables, and an energy conversion loss caused by the rotation of the motor.

The submerged pump has a problem in that magnetic bearings are required to be used on the iron core of the rotor of the motor. Since magnetic iron plates are made of ferrite, they are brittle and have low tolerances for tensile or bending stresses at low temperatures. Therefore, the rotational speed of the motor cannot be increased due to limitations on centrifugal stresses. If the motor is of high output power, then the rotor thereof is required to be long enough to have low inherent values, which would make it difficult to get a suitable motor design available even with the above-mentioned rotational speeds.

SUMMARY OF THE INVENTION

It is therefore an object of the present invention to provide a self-contained pump unit for use in delivering an ultra low temperature liquid fuel under pressure, the turboexpander pump unit having a simple drive system, being free of any leakage of an internal fluid to the exterior, and requiring no external energy supply.

Another object of the present invention is to provide a pump structure for use in such a pump unit.

Still another object of the present invention is to provide a liquefied gas supply installation of the energy saving type which incorporates such a pump unit.

According to the present invention, there is provided a turboexpander pump unit comprising a shaft, a pump connected to an end of the shaft for pressurizing a liquid fluid to a pressure higher than a predetermined delivery pressure, a heat exchanger for heating and converting the liquid fluid pressurized by the pump into a high-pressure gas, and an expander turbine connected to an opposite end of the shaft and actuatable by a thermal energy reduction produced when the high-pressure gas from the heat exchanger is lowered to the predetermined delivery pressure, for flowing out the liquid fluid continuously under a predetermined pressure.

The principles of the present invention will be described below with reference to FIG. 4 of the accompanying drawings.

A fluid is polytropically pressurized, taking a loss into account, by a pump from a state $S_0$ under a pressure $P_0$ close to the atmospheric pressure up to a pressure $P_1$ at a state $S_1$. The fluid is heated by a heat exchanger into a gas at a state $S_2$ in which its pressure is lower by a loss caused by the heat exchanger. From the state $S_2$, the gas is polytropically expanded into a state $S_3$ which is shifted a turbine loss along an enthalpy-constant curve. Subsequently, the gas goes to a state $S_4$ due to an isobaric change if it will be used as a turbine fuel, or goes to a state $S_5$ due to an isenthalpy change if to be delivered over a long distance.

According to the present invention, the expander turbine is actuated using the difference between the gradients of an isentropy curve in a supersaturated liquid range and an isentropy curve in a superheated state, with a differential pressure $P_2-P_d$ by setting the pressure $P_1$ higher than a discharge pressure $P_d$ required of the pump.

The above system is established when the following condition is met:

$$i_2-i_3>i_1-i_0$$

where $i_0$, $i_1$, $i_2$, $i_3$ represent respective enthalpies of the states $S_0$, $S_1$, $S_2$, $S_3$. The states $S_1$, $S_2$ may be established so that the above condition will be met.

To thus establish the states $S_1$, $S_2$, there are available two degrees of freedom, i.e., changing the pressure $P_1$ and applying heat to vary the entropy increase $i_2-i_1$ while keeping the pressure $P_1$ at a suitable high level. If the quantity $i_2-i_3$ is sufficiently larger than the quantity $i_1-i_0$, then the entire amount of the liquid discharged from the pump may not be used, but a portion thereof may be used to actuate the pump, and the remainder to generate electric energy. In such a case, a generator may be connected to a shaft end of the expander turbine to generate electric energy though need arises for frequency adjustments.

Establishment of such a system will be described below with respect to an example in which liquid hydrogen is employed.

Liquid hydrogen having a saturated pressure of 0.12 MPa (i'=261 kJ/kg, s'=11.08 kJ/kg.deg) at 21° K. is to be delivered under pressure as a gas having a pressure $P_d$=7.5 MPa. First, the pressure of the liquid hydrogen is to be increased up to a pressure P=12 MPa by a pump, and then its temperature to 300° K. by a heat exchanger having a loss of 1.5 MPa, after which the liquid hydrogen is to be expanded into a gas having a pressure of 7.5 MPa by an expander turbine. If $P_k$=12 MPa, $T_{1S}$=24.4° K., $i_{1S}$=440.4 kJ/kg, and the pump efficiency is 60%, then the state $S_1$ is expressed by:

$$i_1-i_0=(i_{1S}-i_0)/\eta p=(440.4-261)/0.60=299.0 \text{ kJ/kg.}$$

Since the state $S_2$ has a pressure $P_2$=0.5 MPa and a temperature $T_2$=300° K., it is expressed by:

$$i_2=430.6 \text{ kJ/kg, } s_2=46.0 \text{ kJ/kgp·deg.}$$

If the pressure is isenthalpically lowered to 7.5 MPa, then $$T_{3S}=268\ k,\ i_{3S}=3827.24 \text{ kJ/kg.}$$

If the overall adiabatic efficiency ηe is θe=70%, then $$i_2-i_3=(i_2-i_{3S})\eta e=(4308.6-3827.24)\times 0.7=336.95 \text{ kJ/kg.}$$

In the above equations, the suffix "S" indicates a theoretical value at the time the efficiency is 100%.

Consequently, the condition $i_2-i_3>i_1-i_0$ is met, and the pump can sufficiently be actuated. That is, the pressure $P_2$ or the temperature $T_2$ may be lower.

Similar calculations indicate that even when liquid methane, which is a primary ingredient of LNG, is handled, the pump can be actuated by appropriately selecting the pressure $P_2$ insofar as the temperature $T_2$ is about a normal temperature.

The pump may have at least two outlet ports for discharging the liquid fluid at respective different pressures, one of the at least two outlet ports being connected to the heat exchanger. By selecting one of the outlet ports which is either a high- or low-pressure port for connection to the heat exchanger, the turboexpander pump unit may be used in a wide range of applications.

The other of the at least two outlet ports may be connected to a liquid delivery line.

The shaft is usually a vertical shaft, but may be a horizontal shaft. Since bearings are lubricated and cooled by the liquid fluid that flows in the turboexpander pump unit, the bearings should preferably comprise magnetic bearings. The expander turbine may have a non-contact shaft seal disposed around the shaft in a region in which the shaft extends. A gas film is produced in the non-contact shaft seal for sealing the shaft with a gas.

Inasmuch as the pump and the expander turbine operate at different temperatures, they are spaced apart from each other. The turboexpander pump unit may further have a joint pipe disposed hermetically around a portion of the shaft which extends between the pump and the expander turbine, the pump and the expander turbine having respective casings which are held in communication with each other by the joint pipe. Since the shaft is thus prevented from being exposed to the exterior, it does not suffer serious sealing problems.

The joint pipe may have a mechanism for absorbing longitudinal thermal strains caused when the joint pipe is heated. Pressures exerted in the joint pipe from the pump and the expander turbine are substantially equal to each other for thereby balancing the pressures in the joint pipe. The pump may have a non-contact shaft seal disposed around the shaft in a region in which the shaft extends, for allowing the liquid fluid to leak to a limited extent along the shaft. This allows a boundary between a liquid and a gas to be maintained at a suitable position in the joint pipe.

The turboexpander pump unit may also have a line extending outwardly from the joint pipe for adjusting a pressure in the joint pipe to keep a constant pressure therein.

The turboexpander pump unit may further comprise a support base supporting the expander turbine above the pump, the joint pipe being integrally joined to the support base. This arrangement eliminates the need for the mechanism for absorbing longitudinal thermal strains.

The pump may have a plurality of impellers, the impellers including a first-stage impeller having an inlet port which is positioned closer to the expander turbine, so that the low pressure in the pump acts in the joint pipe to facilitate pressure adjustment in the joint pipe.

Alternatively, the pump may have a plurality of impellers, the impellers being divided into a first impeller group for pressurizing the liquid fluid in a first direction and a second impeller group for pressurizing the liquid fluid in a second direction which is opposite to the first direction, the first impeller group containing as many impellers as those of the second impeller group. This arrangement is effective to cancel reactive forces which are applied to the impellers as the fluid is delivered under pressure, thereby lowering a load on thrust bearings.

Further alternatively, the pump may have a plurality of impellers, the impellers being divided into a primary impeller group for pressurizing the liquid fluid downwardly and a secondary impeller group for pressurizing the liquid fluid upwardly, the primary impeller group being disposed above the secondary impeller group, the primary impeller group having an outlet port and the secondary impeller group having an inlet port, the pump further having a flow passage interconnecting the outlet port of the primary impeller group and the inlet port of the secondary impeller group.

According to the present invention, there is also provided a liquefied gas supply installation comprising a liquefied gas storage tank, a first-stage pump disposed in the liquefied gas storage tank, a second-stage pump for pressurizing and delivering a liquid discharged from the first-stage pump, the second-stage pump having an outlet port for discharging the liquid, a heat exchanger for heating and converting a portion of the liquid discharged from the second-stage pump into a high-pressure gas, an expander turbine for driving the second-stage pump when the high-pressure gas supplied to the expander turbine from the heat exchanger is expanded and reduced in pressure, the expander turbine having a gas outlet port for discharging a reduced-pressure gas, a piping connected to the gas outlet port of the expander turbine for delivering the reduced-pressure gas discharged from the expander turbine, and a piping connected to the outlet port of the second-stage pump for delivering the liquid discharged from the second-stage pump.

According to the present invention, there is also provided a liquid pump assembly comprising a shaft, a pump connected to an end of the shaft and having a plurality of impellers for pressurizing a liquid fluid, and a drive mechanism connected to an opposite end of the shaft for driving the pump, the impellers including a first-stage impeller having an inlet port disposed closer to the drive mechanism, whereby the first-stage impeller can pressurize the liquid fluid in a direction toward the end of the shaft.

According to the present invention, there is further provided a pump assembly for delivering under pressure a fluid at a high or low temperature different from a normal temperature, comprising a pump drive shaft, a pump connected to the pump drive shaft, a pressure vessel covering the pump drive shaft, a prime mover for driving the pump, the pump drive shaft extending through the pressure vessel to the prime mover, and a prime mover base disposed upwardly of the pump, the prime mover being mounted on the prime mover base, the pump drive shaft extending through the prime mover base to the prime mover, the pressure vessel and the prime mover base being integrally formed with each other.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
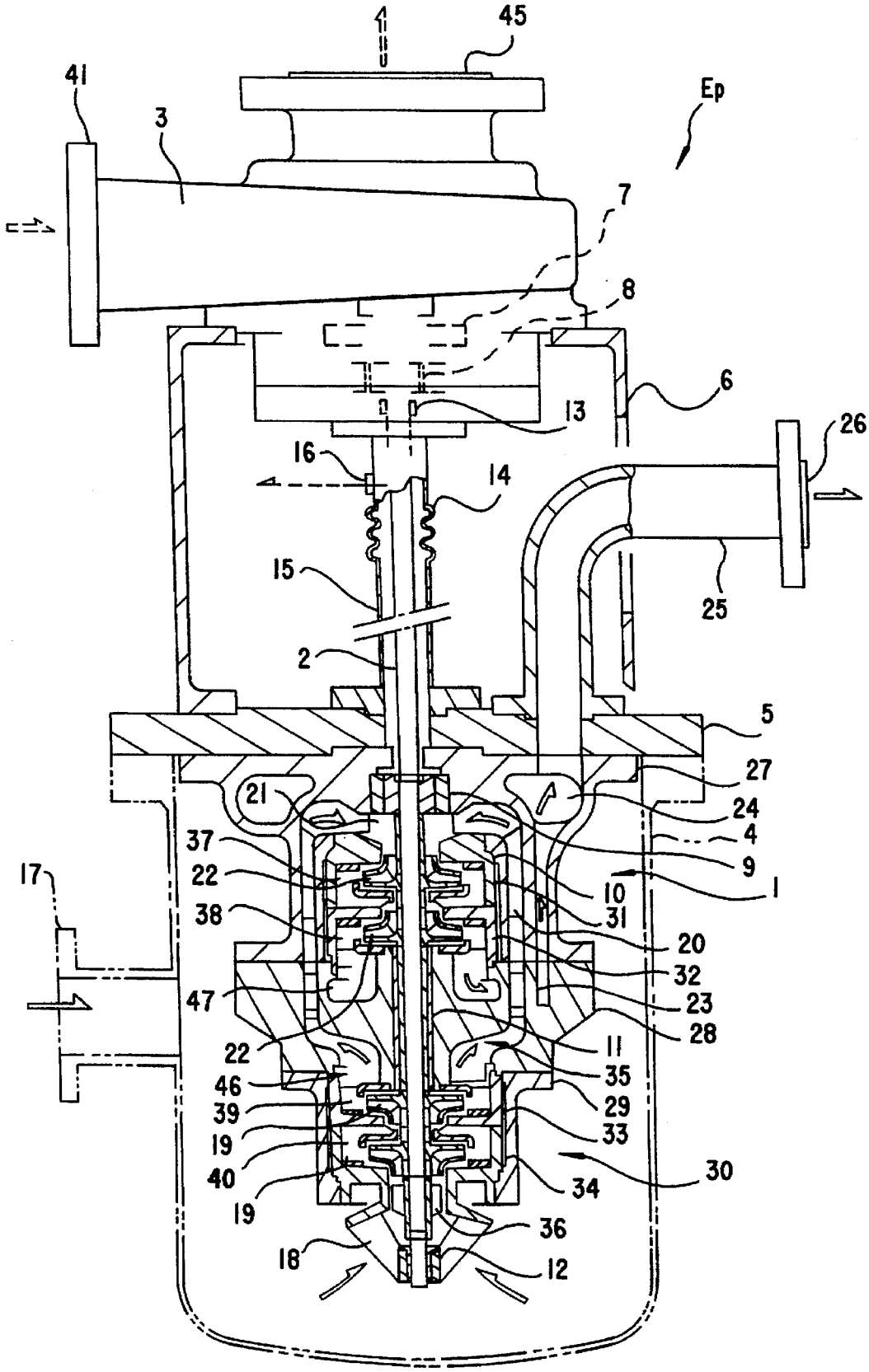
FIG. 1 is a cross-sectional view of a turboexpander pump according to an embodiment of the present invention.

Like or corresponding parts are denoted by like or corresponding reference numerals throughout views.

Figure 2:
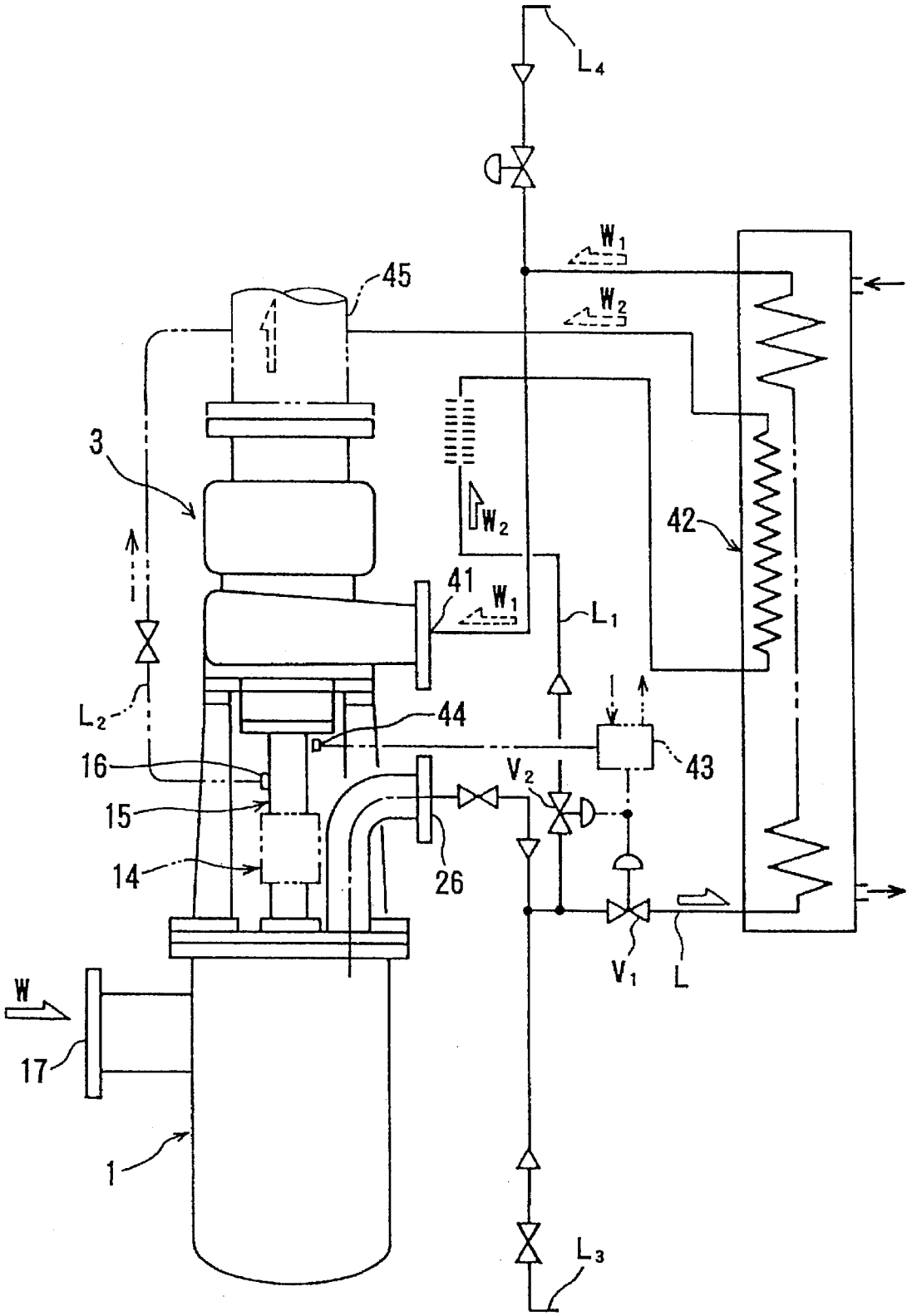
FIG. 2 is an elevational view of a turboexpander pump unit which incorporates the turboexpander pump shown in FIG. 1.

FIG. 1 shows a turboexpander pump Ep according to an embodiment of the present invention, and FIG. 2 shows a turboexpander pump unit which incorporates the turboexpander pump Ep shown in FIG. 1.

As shown in FIG. 1, the turboexpander pump Ep is of a vertical configuration and comprises a pump 1 and an expander turbine 3 disposed above the pump 1 and sharing a common shaft 2 with the pump 1 for rotating the pump 1. The pump 1 and the expander turbine 3 are vertically spaced a distance from each other to reduce mutual thermal effects on each other. The expander turbine 3 is supported on a support base 6 which is mounted on a cover 5 that covers an upper end of a barrel 4 of the pump 1.

The common shaft 2 is rotatably supported by a plurality of bearings which include, arranged successively from above, a thrust bearing 7 and a radial bearing 8 that comprise non-contact magnetic bearings located in the expander turbine 3, an upper bearing 9 and an upper bearing journal 10 that comprise magnetic or static pressure bearings located in the pump 1, a central bushing 11 located in the pump 1, and a lower bearing 12 located in the pump 1 and similar in structure to the upper bearing 9.

A non-contact labyrinth seal 13 is disposed around the common shaft 2 directly below the radial bearing 8. The non-contact labyrinth seal 13 allows a certain amount of gas to flow from the expander turbine 3 downwardly along the common shaft 2. Between the pump 1 and the expander turbine 3, the common shaft 2 is covered with a joint pipe 15 having bellows 14 as a mechanism for absorbing axial or longitudinal thermal strains of the common shaft 2. The joint pipe 15 has a gas discharging opening 16 defined therein above the bellows 14.

The pump 1 is fixedly disposed in the barrel 4 and depends downwardly from the cover 5. The barrel 4 has a liquid supply opening 17 for introducing a liquid into the barrel 4. The pump 1 operates while being surrounded by a liquid introduced from the liquid supply opening 17 into the barrel 4. The pump 1 draws in the liquid from a lower first inlet port 18, pressurizes the liquid upwardly with a two-stage primary impeller 19, introduces the liquid through a first passage 20 into a two-stage secondary impeller 22 from an upper second inlet port 21, pressurizes the liquid downwardly with the two-stage secondary impeller 22, and discharges the liquid through a second passage 23, an outlet chamber 24, an outlet pipe 25, and an outlet port 26.

The pump 1 has a casing structure composed of an outer casing assembly 30 which comprises an outlet casing 27, an intermediate casing 28, and a lower casing 29, and an inner casing assembly 35 which comprises an upper inlet casing 31, an inner casing 32, an intermediate casing 33, and a lower inlet casing 34. The pump 1 also has an inducer 36, upper guide vanes 37, upper final guide vanes 38, lower final guide vanes 39, and lower guide vanes 40.

As shown in FIG. 2, the outlet port 26 of the pump 1 is connected to a gas inlet port 41 of the expander turbine 3 by a line L having a heat exchanger 42 in which heat is transferred between a heat source fluid at a normal temperature, such as seawater, and a fluid at low temperature. The line L also has a flow control valve $V_1$ which is connected to and controlled by a controller 43. To the controller 43, there is also connected a rotational speed sensor 44 for detecting the rotational speed of the shaft 2 and supplying the detected rotational speed to the controller 43. The line L is branched off into a line $L_1$ upstream of the valve $V_1$, and the line $L_1$ is connected to a flow control valve $V_2$ which is connected to and controlled by the controller 43, and an outlet pipe 45 of the expander turbine 3 through the heat exchanger 42. The gas discharging opening 16 of the joint pipe 15 is also connected to the outlet pipe 45 through a line $L_2$. The line L is also branched off into a starter line $L_3$ upstream of the valve $V_1$, the starter line $L_3$ being connected to a primary pump (not shown) through a valve. The line L is further branched off into an excess gas line $L_4$ upstream of the gas inlet port 41, the excess gas line $L_4$ being usable in starting the expander turbine 3.

Operation of the turboexpander pump unit shown in FIG. 2 will be described below. In FIG. 2, thicker arrows represent main fluid flows handled by the pump 1 and the expander pump 3, thinner arrows represent secondary fluid flows required by the turboexpander pump unit, solid-line arrows represent liquid flows, and dotted-line arrows represent gas flows. The above definition of the arrows will also be used with reference to other figures.

The pump 1 cannot be started by itself. To start the pump 1, the expander turbine 3 is started by sending a gas under a high pressure through the line $L_3$ or $L_4$. When the pump 1 is thus started until its rotational speed reaches a predetermined speed, the relationship $i_2-i_3>i_1-i_0$, described above, is satisfied, and subsequently the rotational speed of the pump 1 is automatically increased to the point where the energies are balanced. The rotational speed of the pump 1 is detected by the rotational speed sensor 44, and supplied to the controller 43 which controls the flow control valves $V_1$, $V_2$ to adjust the rate of flow to the heat exchanger 42 for controlling the rotational speed of the pump 1. The rotational speed of the pump 1 can also be controlled by adjusting the rate of flow and the temperature of a heated gas. A generator may be connected directly to the expander turbine 3 for generating electric energy with excess energy supplied to the expander turbine 3.

A liquid fluid at low temperature, such as an LNG, liquid hydrogen, or the like, flows into the barrel 4 from the liquid supply opening 17 thereof, and is drawn into the pump 1 through the lower first inlet port 18 that is positioned near the bottom of the pump 1. The fluid is given energy by the inducer 36, introduced into and given energy by one impeller unit of the two-stage primary impeller 19, introduced through the lower guide vanes 40 into and given energy by the other impeller unit of the two-stage primary impeller 19, and then introduced through the lower final guide vanes 39 into an outlet chamber 46 of the primary impeller 19. The fluid then flows upwardly through the first passage 20, reverses its direction at the upper end of the first passage 20, is drawn through the upper second inlet port 21 into the secondary impeller 22. The fluid is given energy by the secondary impeller 22 in the same manner as by the primary impeller 19, and then flows through the upper final guide vanes 38 into a final inner outlet chamber 47, from which the fluid flows upwardly through the outlet chamber 24 and the outlet pipe 25 out of the outlet port 26.

The fluid discharged from the outlet port 26 enters the heat exchanger 42 which increases the temperature of the fluid to convert the fluid into a high-pressure gas at a normal temperature. The gas then flows through the gas inlet port 41 into the expander turbine 3 in which the gas releases its energy, lowering its pressure, and becomes a gas under a prescribed delivery pressure. The gas is then delivered from the expander turbine 3 through the outlet pipe 45 toward a place where it will be consumed.

Figure 4:
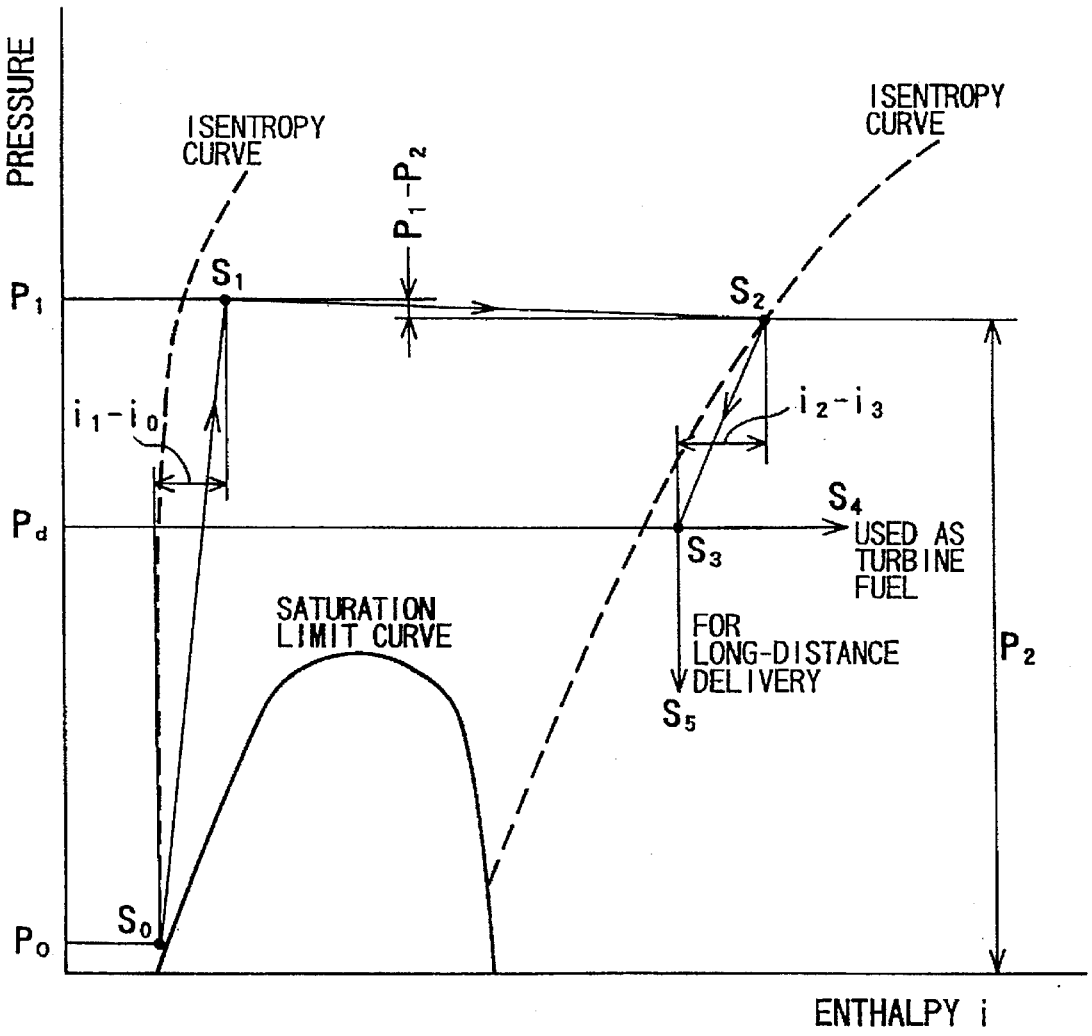
FIG. 4 is a pressure-enthalpy diagram illustrative of the principles of the present invention.

In the above process, the fluid drawn into the pump 1 at a state $S_0$ in FIG. 4 is pressurized and forced into the heat exchanger 42 at a state $S_1$. In the heat exchanger 42, the fluid is heated into a state $S_2$ and becomes a gas. The gas then flows into the expander turbine 3 in which it is expanded into a state $S_3$, and then delivered out of the expander turbine 3 under a prescribed delivery pressure.

The joint pipe 15 which vertically extends intermediate between the pump 1 and the expander turbine 3 includes the bellows 14 which can elastically absorb axial displacements or strains of the joint pipe 15. The joint pipe 15 is not thermally insulated, but allows atmospheric heat to be applied thereto. Therefore, a liquid level is present in the joint pipe 15 with a gas phase above the liquid level. The pressure of the gas phase is equal to the pressure in the upper second inlet port 21 in the pump 1. If the pressure of the gas phase is substantially equal to, and not lower than, the delivery pressure in the outlet pipe 45, then the pressure in the upper second inlet port 21 and the delivery pressure in the outlet pipe 45 balance each other. For example, if the delivery pressure in the outlet pipe 45 is half the pressure in the outlet port 26 of the pump 1, then the pressure intermediate between the primary and secondary impellers is applied to the upper portion of the pump 1. The fluid pressures which act on the primary and secondary impellers are applied in the opposite directions and are of substantially the same magnitude, so that reactive forces applied from the fluid to the primary and secondary impellers cancel each other, thereby reducing the load imposed on the bearings.

The gas that is evaporated in the joint pipe 15 by the applied atmospheric heat is led from the gas discharging opening 16 through the line $L_2$ into the outlet pipe 45. The region of the turbine expander 3 through which the shaft 2 extends is subject to the differential pressure between the pressure of the gas supplied to the expander turbine 3 and the pressure in the joint pipe 15. Since a pressure reduction is achieved by a balancing piston which is used to balance turbine thrust forces, the differential pressure that is actually applied to the labyrinth seal 13 is the back pressure of the balancing piston, and does not largely differ from the pressure in the line L. Stated otherwise, the gas pressure of the expander turbine 3 is reduced by the two pressure reducers, i.e., the balancing piston and the labyrinth seal 13, into the pressure in the joint pipe 15 which is substantially equal to the pressure of the gas discharged from the expander turbine 3.

In this manner, the pump 1 is fully held in a liquid at a specified temperature and the expander turbine 3 is fully held in a gas at a normal temperature. The pump 1 and the expander turbine 3 are interconnected by the shaft 2 and the joint pipe 15, so that they are sealed in a closed structure fully isolated from the atmosphere.

In FIG. 1, only the expander turbine 3 is shown as having the thrust bearing 7. However, the expander turbine 3 and the pump 1 may be connected to each other by a flexible coupling, and may have respective thrust bearings.

Though the terms "liquid" and "gas" have been used above, they may not strictly be distinguished from each other under pressures higher than the critical pressure. For this reason, the terms "liquid" and "gas" are defined as follows: While the medium is being polytropically pressurized from the saturated state (hence there is little volume change), a state in which dv/dp is small is referred to as a liquid, and a state in which dv/dp is as large as a gas is referred to as a gas.

Transportation of a gas over a long distance, using the turboexpander pump unit according to the present invention, will be described below.

The principles of the present invention, described above with reference to FIG. 4, indicate that the state $S_2$ can be selected with considerably large freedom. If it is assumed in FIG. 2 that the fluid flowing into the pump 1 has a mass flow rate W (kg/s) and the gas required by the expander turbine 3 to actuate the pump 1 has a mass flow rate $W_1$ (kg/s), then the mass flow rate $W_1$ is determined by:

$$\begin{aligned} W_1 &= \{(i_1 - i_0)/(i_2 - i_3)\}W \\ &= [\{(i_1s - i_0)/(i_2 - i_3s)\}/(\eta p \cdot \eta e)]W \end{aligned}$$

where ηp represents the efficiency of the pump and ηe represents the overall adiabatic efficiency of the expander turbine. Therefore, since $$W_1/W=\{(i_1s-i_0)/(i_2-i_3s)\}/(\eta p\cdot\eta e),$$

there is a sufficient possibility of $W_1/W<1$, i.e., $W_1<W$. In the above example of numerical values, $W_1=0.89$ W.

The difference $W-W_1$, i.e., a remainder mass flow rate $W_2$, is only 11% in the above example of numerical values. However, the mass flow rate $W_2$ can be increased by selecting the state $S_2$, and the mass flow rate W may be increased depending on the size of the turboexpander pump unit. Therefore, the mass flow rate $W_2$ can be of a quantity that is practically sufficiently significant.

In FIG. 2, the liquid of the remainder mass flow rate $W_2$(=$W-W_1$ (kg/s)) is delivered in bypassing relation to the expander turbine 3, reduced in pressure by an orifice, heated, cooled, and recovered as a gas which is introduced into the outlet pipe 45. However, the liquid of the remainder mass flow rate $W_2$ may be delivered as it is separately from the gas flow in the outlet pipe 45.

Figure 3:
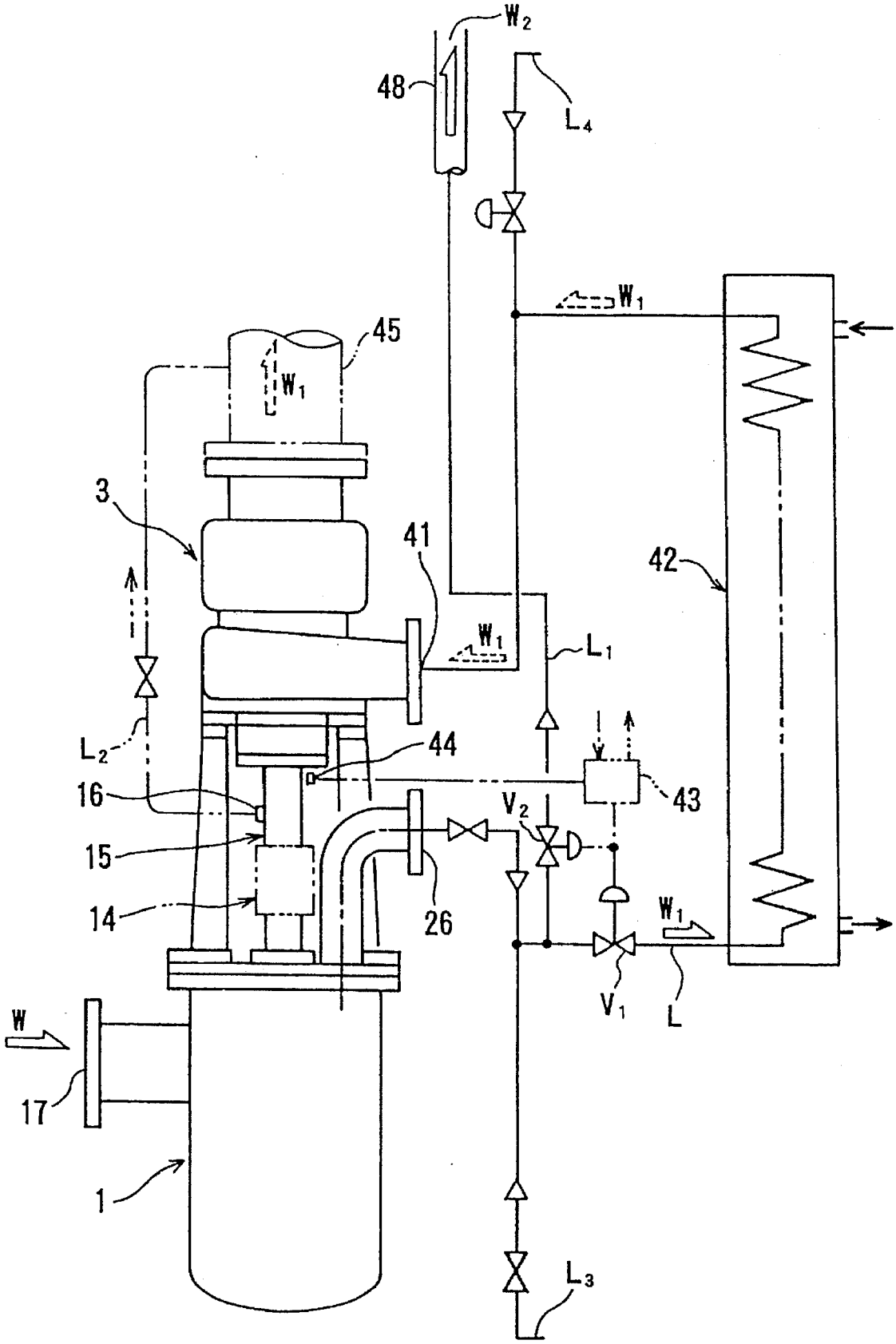
FIG. 3 is an elevational view of another turboexpander pump unit which incorporates the turboexpander pump shown in FIG. 1.

FIG. 3 shows another turboexpander pump unit which incorporates the turboexpander pump shown in FIG. 1, the turboexpander pump unit being arranged to deliver the liquid of the remainder mass flow rate $W_2$ separately from the gas flow in the outlet pipe 45. While the line $L_1$ is connected through the heat exchanger 42 to the outlet pipe 45 in FIG. 2, the line $L_1$ is connected to a liquid delivery pipe 48 in the arrangement shown in FIG. 3. The turboexpander pump unit shown in FIG. 3 is preferably used in an application in which a gas is employed to generate electric energy at the site of the unit and a liquid is required to be delivered for transportation over a long distance. If the pressure $P_1$ is too high for the required delivery pressure, then it may be reduced to the required pressure by a gas recovery turbine for energy recovery.

Figure 5:
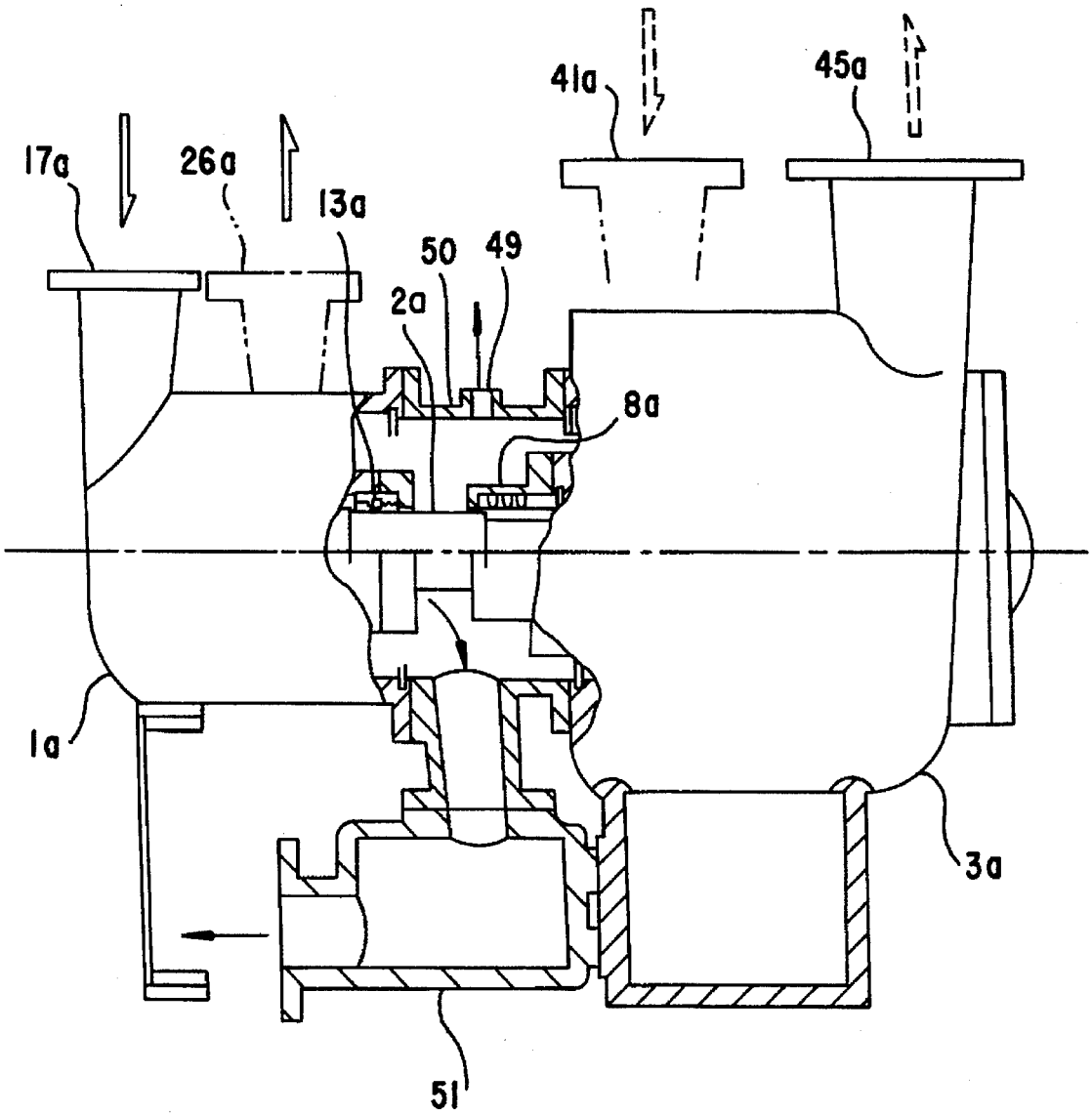
FIG. 5 is an elevational view, partly in cross section, of a turboexpander pump according to another embodiment of the present invention.
Figure 6:
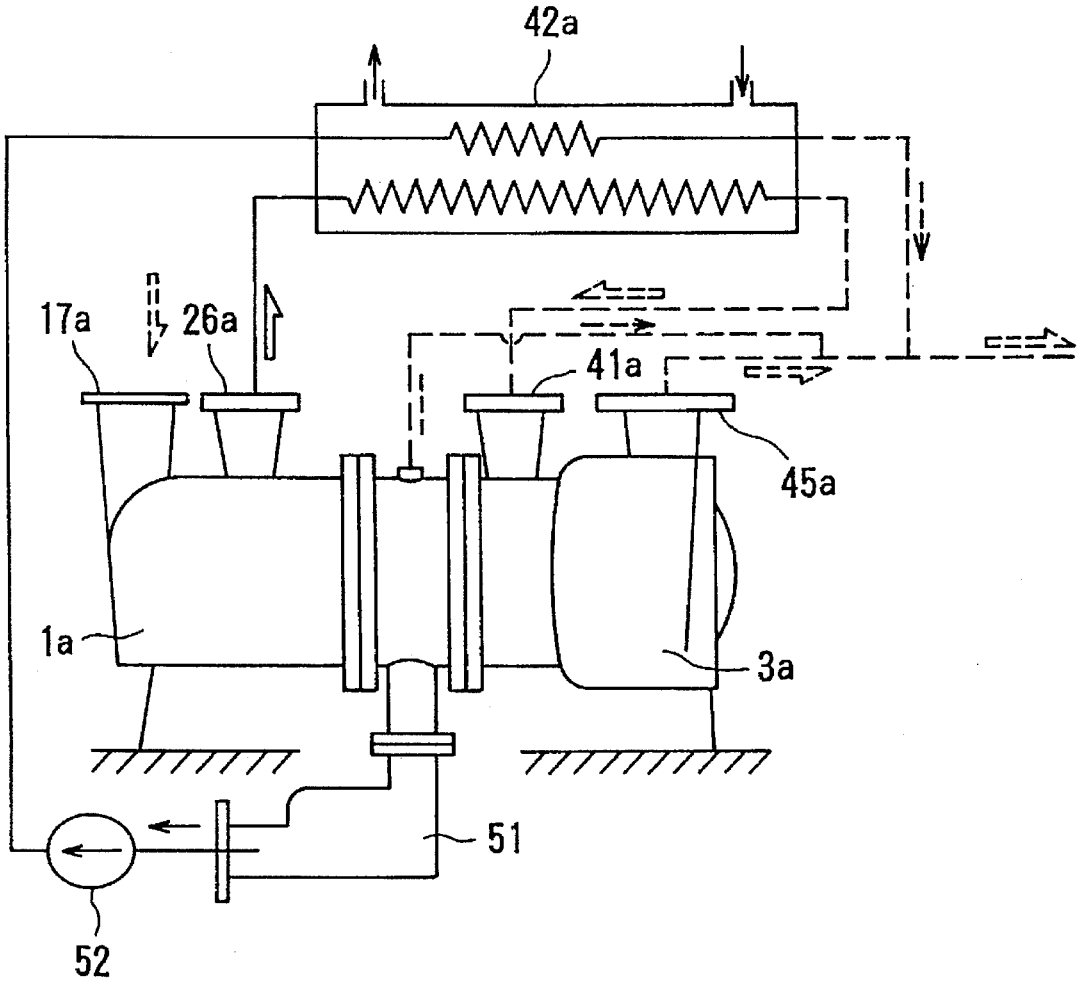
FIG. 6 is a view showing fluid flows with respect to the turboexpander pump shown in FIG. 5.

FIGS. 5 and 6 show a turboexpander pump according to another embodiment of the present invention. In this embodiment, the turboexpander pump has a horizontal shaft 2*a*, a pump 1*a* mounted on one end of the shaft 2*a*, and an expander turbine 3*a* mounted on the other end of the shaft 2*a*. The pump 1*a* and the expander turbine 3*a* are connected to each other by a joint barrel 50 having an opening 49 defined in an upper wall thereof. A drain recovery casing 51 is attached to a lower wall of the joint barrel 50. Other details of the turboexpander pump shown in FIGS. 5 and 6 are substantially the same as those shown in FIG. 1, and corresponding parts are denoted by corresponding reference numerals with a suffix "a". The turboexpander pump shown in FIGS. 5 and 6 has a non-contact shaft seal 13*a* for allowing a liquid to leak to a certain extent from the pump la and a non-contact labyrinth seal 8*a* in the expander turbine 3*a*.

As shown in FIG. 6, a liquid flows in the state $S_0$ (see FIG. 4) from the liquid supply opening 17*a* into the pump 1*a*, and is then pressurized into the state $S_1$. The liquid is thereafter discharged from the outlet port 26*a* and enters the heat exchanger 42*a*. In the heat exchanger 42*a*, the liquid is heated into the state $S_2$, flows as a gas into the expander turbine 3*a* through the gas inlet port 41*a*, and is reduced in pressure into the state $S_3$. The gas is then discharged from the expander turbine 3*a* through the outlet port 45*a*, and delivered under a prescribed delivery pressure.

The pressure in the joint barrel 50 is basically equal to and slightly higher than the delivery pressure of the gas in the state $S_3$ because of the stages of the pump 1*a*. Any gas leakage from the expander turbine 3*a* into the joint barrel 50 flows through the non-contact labyrinth seal 8*a*. In the joint barrel 50, there is developed a certain differential pressure equal to the head or pressure drop across the expander turbine 3*a* or a pressure produced by lowering the head with a balancing piston. There is basically no or slight differential pressure in the region of the pump 1*a* through which the shaft 2*a* extends. The liquid is prevented from leaking from that region of the pump 1*a* by a non-contact shaft seal similar to a mechanical seal, or a floating ring or the like, which allows a certain amount of liquid to leak. Such a seal mechanism permits the turboexpander pump to have a desired service life as an industrial machine.

Inasmuch as the pressure in the joint barrel 50 is basically the same as the delivery pressure of the gas in the state $S_3$, any gas leaking from the expander turbine 3*a* and a gas produced when the liquid leaks from the pump 1*a* can be introduced from the opening 49 into the outlet port 45*a* of the expander turbine 3*a*, i.e., a delivery line from the expander turbine 3*a*.

Any liquid leaking from the pump 1*a*, which is recovered from the joint barrel 50 into the drain recovery casing 51, has basically the same pressure as that in the delivery line, and hence can be introduced into the delivery line by a small-size recovery pump 52. It is preferable to pass the leaking liquid through the heat exchanger 42*a* to recover thermal energy from the liquid, thereby converting the liquid into a gas, and introduce the gas into the delivery line.

Insofar as each of the turboexpander pump units described above is used with a liquefied gas at low temperature, it is convenient because it does not require a high-temperature heat source for heating the liquid, but may employ a normal-temperature heat source such as seawater or an external waste heat source. As the turboexpander pump unit needs no operating electric energy while it is in operation, it is suitable for use in a self-contained liquefied gas supply system. The turboexpander pump unit contains only the fluid handled thereby, and hence the expander turbine and the pump thereof do not require use of contact shaft seals such as ordinary mechanical seals, floating rings, or the like. Since the turboexpander pump unit is fully sealed against the atmosphere, it does not cause a fluid leakage into the exterior and does not allow internal components to be contaminated by external sources. For manufacturing liquefied nitrogen or the like by recovering thermal energy from a low-temperature liquefied gas, the turboexpander pump unit is highly useful to cool the gas which has been compressed to a high temperature. Depending on the discharge pressure of the pump and the capacity of the heat exchanger, the turboexpander pump unit can be operated at a sufficiently high speed. Because the rotational speed and output capacity of the turboexpander pump unit can be determined by both the discharge pressure of the pump and the temperature at the outlet of the heat exchanger, the turboexpander pump unit can be designed and controlled with high adaptability.

An turboexpander pump according to still another embodiment of the present invention will be described below with reference to FIG. 7.

Figure 7:
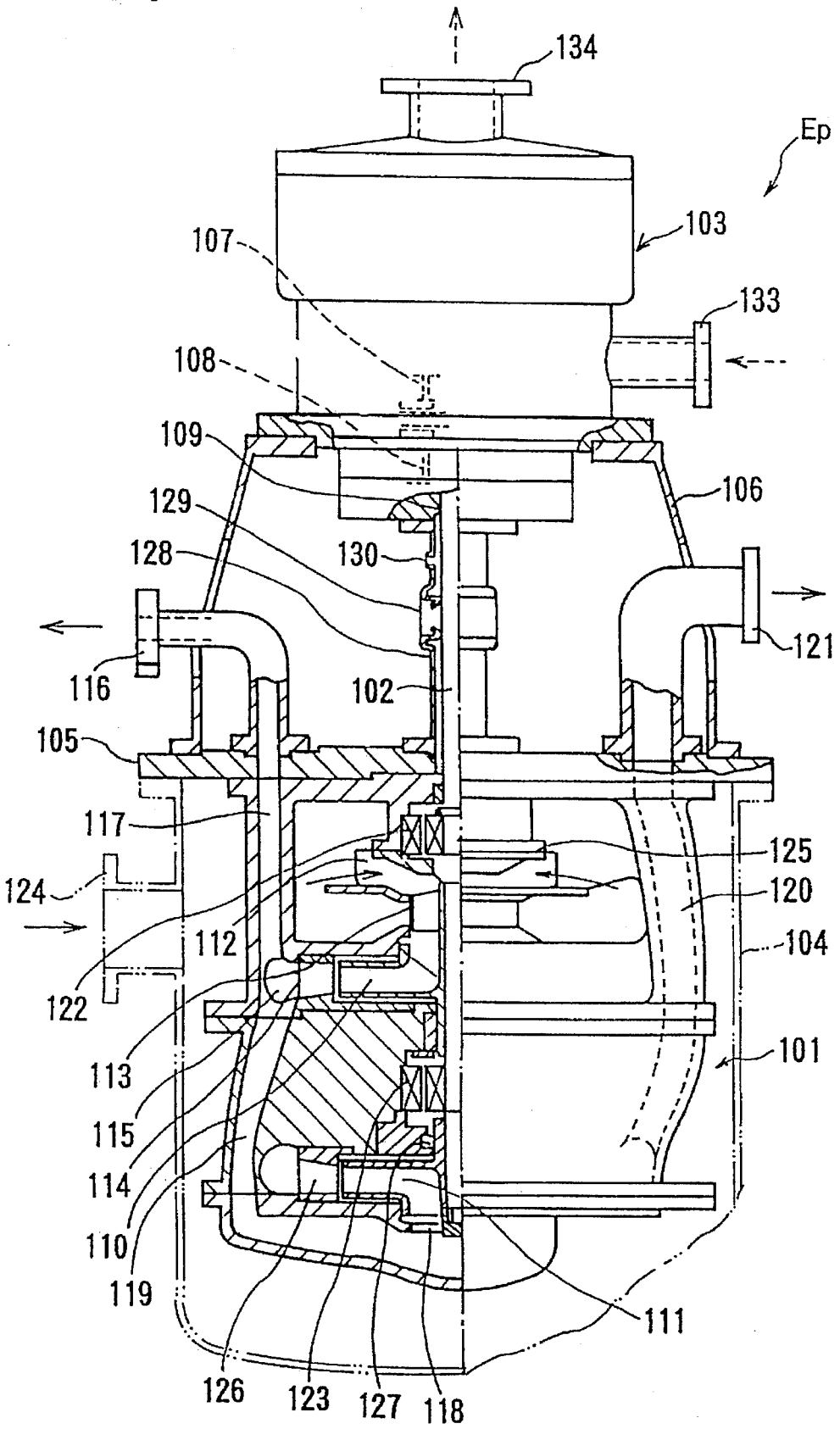
FIG. 7 is an elevational view, partly in cross section, of a turboexpander pump according to still another embodiment of the present invention.

The turboexpander pump, generally denoted by Ep in FIG. 7, differs from the turboexpander pumps according to the previous embodiments with respect to a pump structure. While the pump has only one outlet port in the previous embodiments, the pump according to this embodiment has two outlet ports for discharging a liquid at different discharge pressures. Furthermore, the pump according to this embodiment has a primary impeller disposed in an upper portion thereof and a secondary impeller disposed in a lower portion thereof.

Specifically, the turboexpander pump Ep has a pump 101 and an expander turbine 103 disposed above the pump 101 and sharing a common shaft 102 with the pump 101 for rotating the pump 101. The pump 101 is fixed to a lower surface of a cover 105 and supported thereby, and the expander turbine 103 is supported on a support base 106 which is disposed on an upper surface of the cover 105. The pump 101 has an upper primary impeller 110 and a lower secondary impeller 111. The primary impeller 110 pressurizes a liquid which is introduced from an upper inlet port 112 through an inducer 113 connected thereto, and delivers the liquid through a diffuser 114 into an annular passage 115 connected thereto. The annular passage 115 is connected to a first passage 117 extending to a first outlet port 116 of the pump 101 and a second passage 119 extending to an inlet port 118 of the secondary impeller 111. The liquid which is further pressurized by the secondary impeller 111 is delivered through a third passage 120 into a second outlet port 121 of the pump 101. The common shaft 102 is supported in the expander turbine 103 by a thrust bearing 107 and a radial bearing 108 which each comprise a non-contact magnetic bearing, and also supported in the pump 101 by a radial magnetic bearing 122 and a radial magnetic bearing 123 that are positioned respectively upwardly and downwardly of the secondary impeller 111. A non-contact labyrinth seal 109 is disposed around the common shaft 102 immediately below the radial bearing 108.

While only one primary impeller 110 and only one secondary impeller 111 are shown in FIG. 7, the turboexpander pump Ep may have a plurality of primary impellers and a plurality of as many secondary impellers as the primary impellers.

Operation of the turboexpander pump Ep will be described below.

A liquid fluid flowing from a liquid supply opening 124 into the barrel 104 submerges the entire pump 101 therein. The liquid fluid flowing at an ultra low temperature from the inlet port 112 into a pump casing is held in contact with a surface of an upper bearing casing 125, and hence cools the radial magnetic bearing 122 at all times. The liquid fluid then flows through the inducer 113 and the primary impeller 110 which pressurizes the liquid fluid. The liquid fluid then passes through the diffuser 114 into the annular passage 115 from which the liquid fluid is branched into the first and second passages 117, 119. The liquid fluid that has entered the first passage 117 is discharged as a pressurized liquid fluid from the outlet port 116, and the liquid fluid that has entered the second passage 119 is directed toward the inlet port 118 of the secondary impeller 111. The liquid fluid then flows through inlet port 118 into the secondary impeller 111, and is pressurized thereby. The pressurized liquid fluid flows through a diffuser 126, and is delivered from the second outlet port 121 to a heat exchanger (not shown).

A portion of the liquid that has been pressurized by the secondary impeller 111 flows upwardly along the shaft 102, lubricates a touchdown ball bearing 127, cools the radial magnetic bearing 123 which is positioned above the touchdown ball bearing 127, and flows into a region behind the primary impeller 110. Since this liquid flow is directed upwardly, it efficiently removes a gas that is generated, thereby effectively preventing scuffing of the components. Thrust forces acting on the shaft 102 are the sum of its own weight, a shaft load determined by a pressure distribution on the impellers 110, 111, and forces produced by a change in the momentum of the flow of the liquid fluid. The thrust forces can substantially be balanced because the primary and secondary impellers 110, 111 are directed in opposite orientations.

The cover 105 which closes the barrel 104 has a gas draining pipe (not shown) for draining a gas produced in the barrel 104 upwardly therethrough.

The non-contact labyrinth seal 109 which is disposed as a shaft seal around the common shaft 102 that rotates at a high speed allows a certain liquid to leak therethrough. Both the liquid fluid leaking from the pump 101 and the gas leaking from the expander turbine 103 flow into the joint pipe 128. The joint pipe 128 has bellows 129 for absorbing axial or longitudinal thermal strains of the shaft 102. A boundary between the liquid fluid and the gas is positioned in the bellows 129. The joint pipe 128 has an opening 130 for discharging a gas having a certain pressure or higher.

The pressure of the boundary between the liquid fluid and the gas in the joint pipe 128 is substantially equal to the pressure in an upper portion of the pump 101 to which the joint pipe 128 is directly connected. Since the inlet port 112 of the primary impeller 110 is disposed in an uppermost portion of the barrel 104, the pressure in the joint pipe 128 is low, reducing the load on the bellows 129. Therefore, the joint pipe 128 including the bellows 129 can easily be fabricated, and has increased durability and safety.

Figure 8:
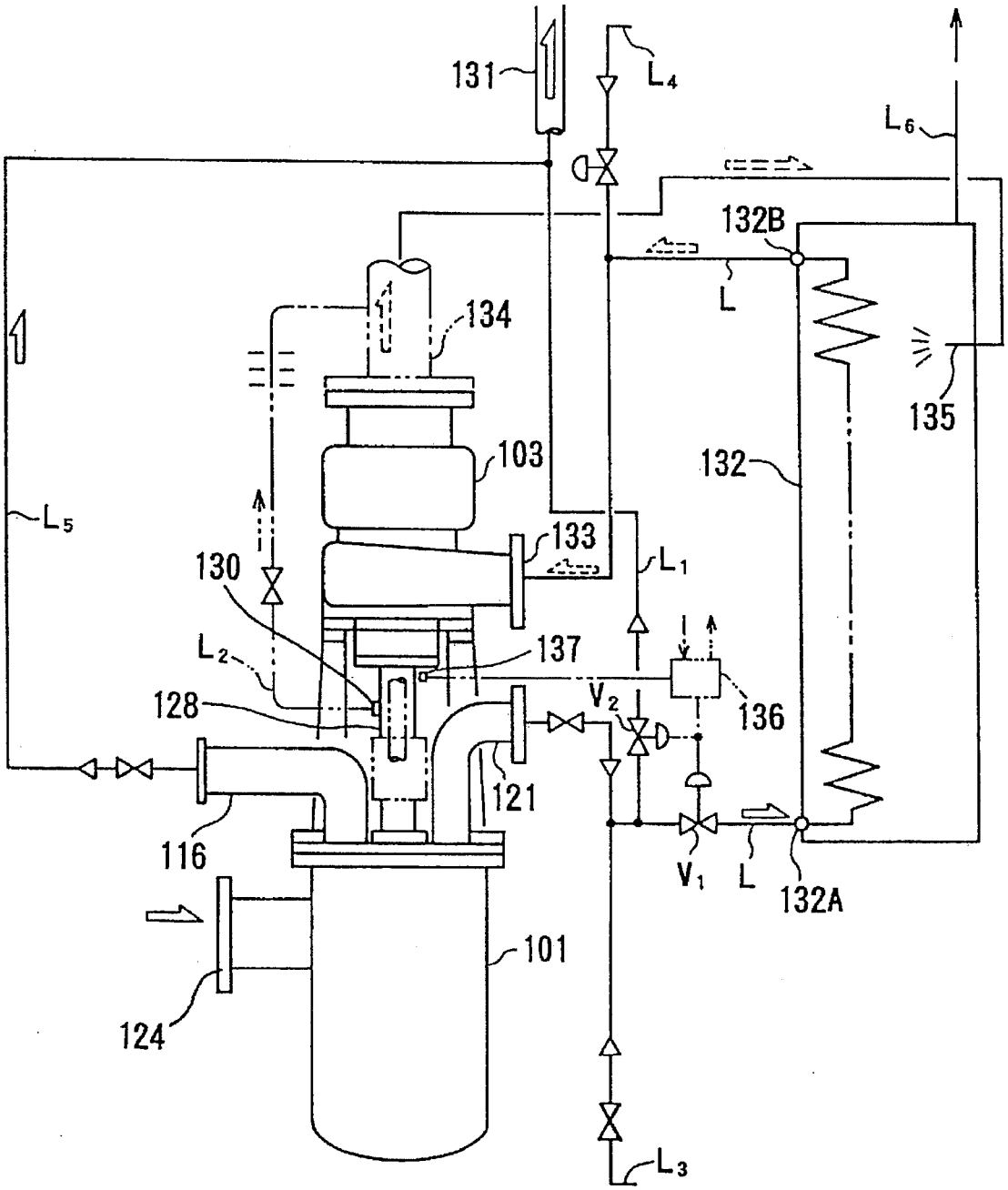
FIG. 8 is an elevational view of a turboexpander pump unit which incorporates the turboexpander pump shown in FIG. 7.

FIG. 8 shows a turboexpander pump unit which incorporates the turboexpander pump Ep shown in FIG. 7. Those parts shown in FIG. 8 which are identical to those in the previous embodiments will not be described in detail below.

The turboexpander pump unit illustrated in FIG. 8 delivers a combustible fluid such as an LNG. The first outlet port 116 of the pump 101 is connected through a line $L_5$ to a liquid fluid delivery line 131, and the second outlet port 121 thereof is connected through a combustion heater 132 in a line L to a gas inlet port 133 of the expander turbine 103. The combustion heater 132 is supplied with a gas from a gas outlet port 134 of the expander turbine 103, and burns the supplied gas with a burner 135 to heat the liquid fluid introduced from the line L. An exhaust gas produced when the gas is burned by the burner 135 is discharged from a line $L_6$.

The line L has a flow control valve $V_1$ which is connected to a controller 136. A rotational sensor 137 for detecting the rotational speed of the shaft 102 is also connected to the controller 136. The line L is branched into a line $L_1$ upstream of the flow control valve $V_1$, the line $L_1$ being connected to a liquid fluid delivery line 131 through a flow control valve $V_2$ that is connected to the controller 136. The opening 130 of the joint pipe 128 is connected through a line $L_2$ to the gas outlet port 134 of the expander turbine 103. If necessary, the line L may have an orifice somewhere in its length. To the line L, there are connected a starter line $L_3$ extending from a primary pump (not shown), and an excess gas line $L_4$ upstream of the gas inlet port 133, the excess gas line $L_4$ being usable in starting the expander turbine 103.

In operation, a liquid fluid W drawn from the liquid supply opening 124 into the pump 101 by the primary pump (not shown) is pressurized to a certain pressure by the pump 101, discharged from the first outlet port 116, and delivered from the liquid fluid delivery line 131 to an external installation, e.g., another LNG base if the liquid fluid is an LNG, through a pipe line. The liquid fluid which has been pressurized to a higher pressure is discharged from the second outlet port 121, flows through the flow control valve $V_1$ and the line L into the combustion heater 132 from its inlet port 132A. The liquid fluid is heated and converted into a gas at a temperature under a high pressure by the combustion heater 132. The gas is then discharged from the combustion heater 132 through its outlet port 132B, and flows into the expander turbine 103 through the gas inlet port 133. In the expander turbine 103, the gas is expanded and rotates the turbine impeller while lowering its pressure.

The turboexpander pump unit cannot be started by itself. To start the turboexpander pump unit, the expander turbine 103 is started by sending a gas under a high pressure through the line $L_3$ or $L_4$. After the burner 135 is turned on, the pump 101 is rotated at a gradually increasing speed until its rotational speed reaches a predetermined speed, whereupon an energy balance is achieved, and subsequently the rotational speed of the pump 101 is automatically increased to the point where the energies are balanced. The rotational speed of the pump 101 is detected by the rotational speed sensor 137, and supplied to the controller 136 which controls the flow control valves $V_1$, $V_2$ to adjust the rate of flow of the liquid fluid to the combustion heater 132 for controlling the rotational speed of the pump 101. The rotational speed of the pump 101 can also be controlled by adjusting the rate of flow and the temperature of a combusted gas in the burner 135. A generator may be connected directly to the expander turbine 103 for generating electric energy with excess energy supplied to the expander turbine 103.

As described above, the turboexpander pump unit shown in FIG. 8 is capable of pressurizing a liquid fluid to transport the same over a long distance, and also of re-pressurizing and heating a portion of the liquid fluid into a gas, and expanding the gas to rotate the turbine impeller for thereby rotating the pump connected to the expander turbine. The liquid fluid can be heated by combusting the gas which has driven and been discharged from the expander turbine.

Another turboexpander pump unit which incorporates the turboexpander pump shown in FIG. 7 will be described below with reference to FIG. 9. According to the embodiment shown in FIG. 8, the combustion heater 132 is used as a heat exchanger. According to the embodiment shown in FIG. 9, however, a warming heater 138 for heating a liquid fluid with a heat source fluid at a normal temperature, e.g., seawater, is used as a heat exchanger, as with the embodiment shown in FIG. 1. The warming heater 138 transfers heat between the heat source fluid at normal temperature and a pressurized fluid at an ultra low temperature which has been introduced from an inlet port 138A thereof, and discharges a gas under a high pressure which has been heated to a normal temperature of about 300° K., from an outlet port 138B thereof. The high-pressure gas from the warming heater 138 is drawn from a line L into an gas inlet port 133 of an expander turbine 103, and expanded to rotate the impeller of the expander turbine 103. Having lost its energy, the gas is slightly lowered in pressure, and delivered as a certain high pressure from a gas outlet port 134 into an external line. The other system details of the turboexpander pump unit shown in FIG. 9 are the same as those shown in FIG. 8.

Figure 9:
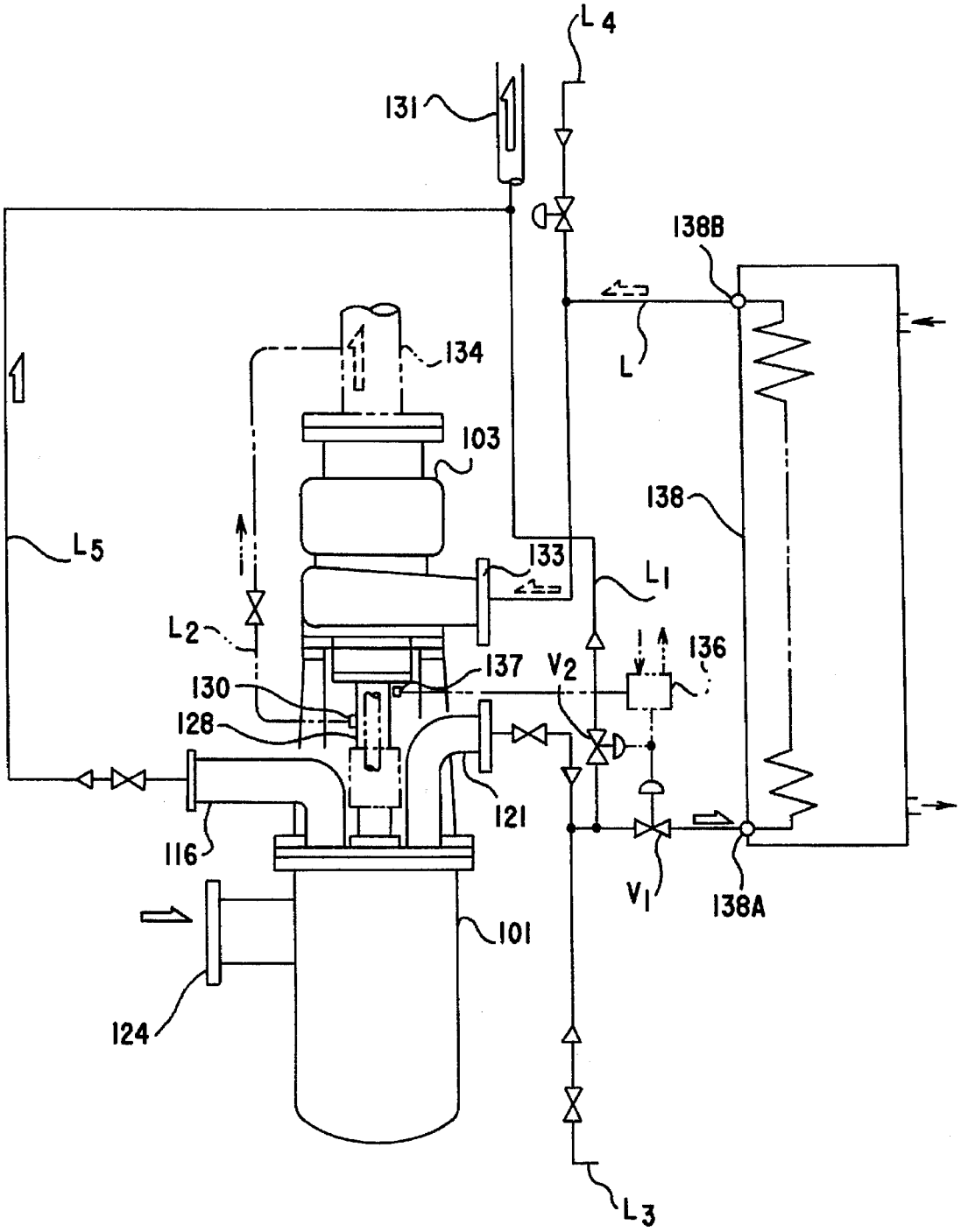
FIG. 9 is an elevational view of another turboexpander pump unit which incorporates the turboexpander pump shown in FIG. 7.

The turboexpander pump units shown in FIGS. 8 and 9 are suitable for use in an LNG base for generating electric energy with a gas (LNG) and delivering a liquid (LNG) over a long distance. If the pressure discharged from the pump 101 is too high for the required delivery pressure, then it may be reduced to the required pressure by a gas recovery turbine for energy recovery.

The principles of operation of the turboexpander pump units shown in FIGS. 8 and 9 will be described below with reference to FIG. 10. A liquid fluid at a low temperature, such as an LNG, liquid hydrogen, or the like is pressurized by the primary pump from a state $S_0$ under a pressure $P_0$ close to the atmospheric pressure up to a pressure $P_1$ at a state $S_1$. The liquid fluid is then polytropically pressurized, taking a loss into account, up to a pressure $P_2$ by the pump 101 which is a secondary pump. Most of the pressurized liquid fluid is delivered from the first outlet port 116. The remaining liquid fluid is further pressurized up to a pressure $P_3$ at a state $S_3$. The liquid fluid is heated by the combustion heater 132 or the warming heater 138, into a gas at a state $S_4$ in which its pressure is lower by a loss caused by the heat exchanger. From the state $S_4$, the gas is polytropically expanded into a state $S_5$ which is shifted a turbine loss along an entropy-constant curve. Subsequently, the gas goes to a state $S_6$ due to an isobaric change at the burner 135 in the combustion heater 132 (see FIG. 8), or is delivered as a gas having a pressure of $P_5$ to an external installation (see FIG. 9).

The expander turbine 103 in each of the above turboexpander pump units is actuated using the difference between the gradients of an isentropy curve in a supersaturated liquid range and an isentropy curve in a superheated state. Such an operating arrangement is established as a system if the following relationship is satisfied:

$$W(i_2-i_1)+w(i_3-i_2)\leqq w(i_4-i_5)$$

where $i_1$, $i_2$, $i_3$, $i_4$, $i_5$ represent respective enthalpies of the states $S_1$, $S_2$, $S_3$, $S_4$, $S_5$ represents the overall amount of the liquid fluid flowing into the pump (kg), and w represents the overall amount of the liquid extracted from the pump (kg). That is, the operating arrangement is established as a system if the following condition is met:

$$W(i_2-i_1)\leqq w(i_4-i_5-i_3+i_2),$$
$$w/W\geqq(i_2-i_1)/(i_4-i_5+i_2-i_3).$$

Therefore, the operating arrangement is established as a system if $(i_2-i_1)/(i_4-i_5+i_2-i_3)$ is equal to or less than 1.

The states $S_3$, $S_4$ may be established to satisfy the above condition for supplying the heated gas to the expander turbine and delivering the gas discharged from the expander turbine as a gas under a high pressure to an external installation. To thus establish the states $S_3$, $S_4$, there are available two degrees of freedom, i.e., changing the pressure $P_3$ and applying heat to vary the entropy increase $i_4-i_3$. If the quantity $w(i_4-i_5)$ is sufficiently larger than the quantity $W(i_2-i_1)+w(i_3-i_2)$, then a portion of the gas may be used to actuate the pump, and the remainder to generate electric energy. In such a case, a generator may be connected to a shaft end of the expander turbine to generate electric energy though need arises for frequency adjustments.

Establishment of such a system will be described quantitatively with respect to an example in which liquid hydrogen is employed.

Liquid hydrogen having a saturated pressure $P_0$=0.12 MPa at 21° K. and an enthalpy $i_0$=270 kJ/kg is to be combusted as a gas having a pressure $P_5$=0.5 MPa. First, the pressure of the liquid hydrogen is to be increased up to a pressure $P_1$=0.28 MPa by the primary pump, and then up to a pressure $P_2$ and delivered by the secondary pump. An extracted portion of the liquid hydrogen is to be re-pressurized up to a pressure $P_3$ =10 MPa, and then its temperature is to be increased up to 500° K. by a heat exchanger (combustion heater) having a loss of 1.5 MPa. Thereafter, the heated liquid hydrogen is to be expanded into a gas having a pressure of 0.5 MPa by the expander turbine. If $P_1$=0.28 MPa, $i_{1S}$=272 kJ/kg, and the pump efficiency $\eta p$=60%, then the state $S_1$ in an isentropy change has an enthalpy $i_1$ as follows:

$$i_1=(i_{1S}-i_0)/\eta p+i_0=(272-270)/0.60+270=273 \text{ kJ/kg}.$$

The state $S_2$ has a pressure $P_2$=7.5 MPa and an enthalpy $i_2$ as follows:

$$i_2=(i_{2S}-i_1)/\eta p+i_1=(370-273)/0.6+273=474 \text{ kJ/kg}.$$

The extracted portion of the liquid hydrogen is pressurized up to the pressure $P_3$=10 MPa at the state $S_3$, in which:

$$\begin{aligned} i_{3s} &= 470 \text{ kJ/kg}, \\ i_3 &= (i_{3s}-i_2)/\eta p+i_2=(470-434)/0.6+434 \\ &= 494 \text{ kJ/kg}. \end{aligned}$$

When the liquid hydrogen is heated to a temperature T=500° K. at the state $S_4$, the state $S_4$ has an enthalpy $i_4$=7180 kJ/kg.

If the overall adiabatic efficiency he of the expander turbine is $\eta e$=70%, then when the pressure of the liquid hydrogen is isentropically lowered to the pressure $P_5$=0.5 MPa, since $i_{5S}$=3030 kJ/kg, $$i_4-i_5=(i_4-i_{5S})\times\eta e=(7180-3030)\times 0.7=2905 \text{ kJ/kg}.$$

Therefore, $$(i_2-i_1)/(i_4-i_5+i_2-i_3)=(434-273)/(2905+434-494)=0.0566.$$

Consequently, it can be seen that the pump can sufficiently be actuated. That is, the pressure $P_3$ or the temperature may be lower. Similar calculations indicate that even when liquid methane, which is a primary ingredient of LNG, is handled, the pump can be actuated by appropriately selecting the pressure $P_3$.

Figure 11:
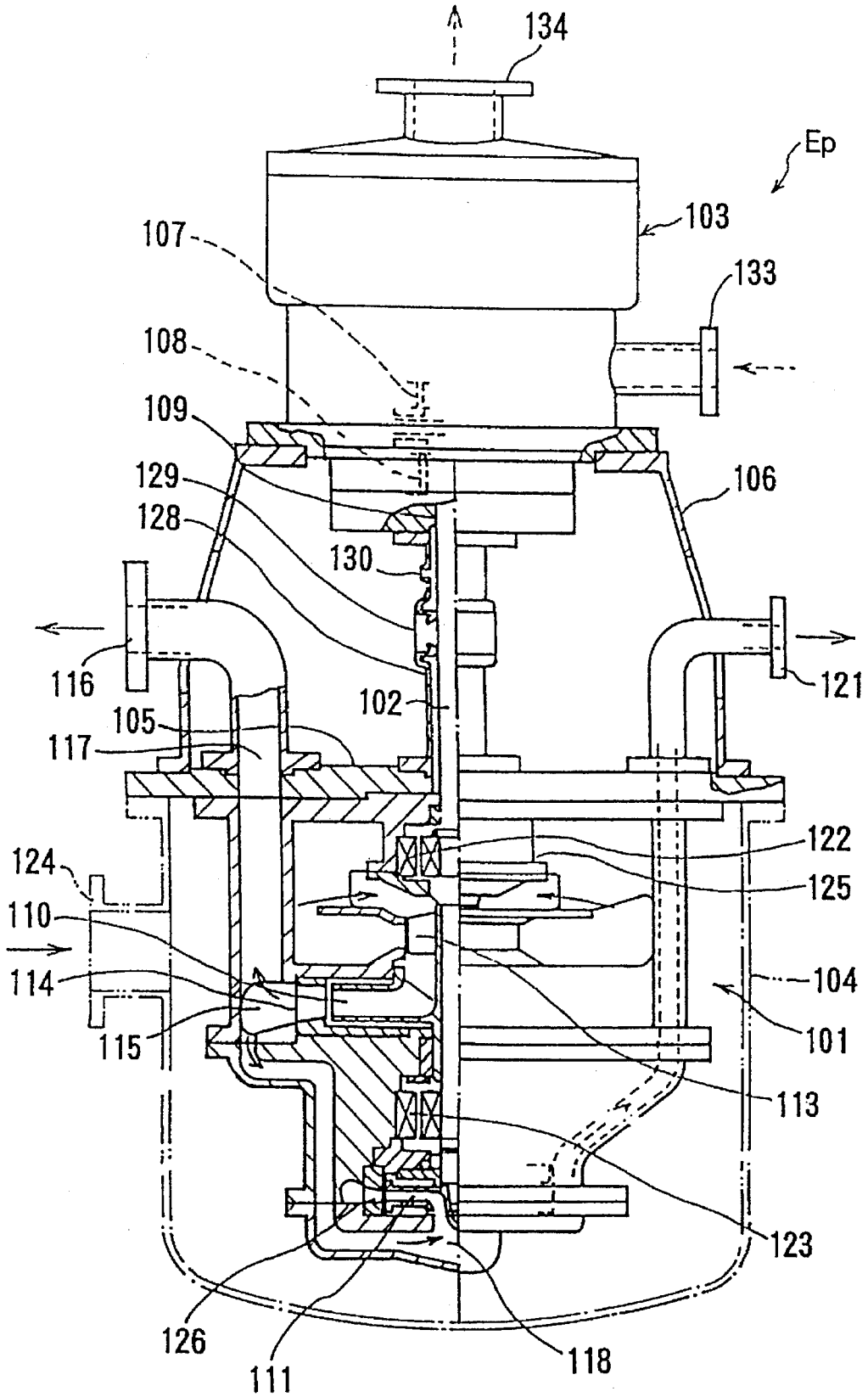
FIG. 11 is an elevational view, partly in cross section, of a turboexpander pump according to a further embodiment of the present invention.

FIG. 11 shows a turboexpander pump Ep according to a further embodiment of the present invention. The turboexpander pump Ep shown in FIG. 11 is essentially the same as, but slightly modified from, the turboexpander pump Ep shown in FIG. 7.

In a turboexpander pump unit which incorporates the turboexpander pump Ep according to the embodiment shown in FIG. 11, the high-pressure outlet port 121 of the pump 101 is connected to the liquid fluid delivery line (see FIGS. 8 and 9), and the low-pressure outlet port 116 of the pump 101 is connected to the heat exchanger 132 or 138. The turboexpander pump Ep shown in FIG. 11 differs from the turboexpander pump Ep shown in FIG. 7 only in that the outlet ports 116, 121 and outlet pipes connected thereto have diameters that are switched around. The other details of the turboexpander pump Ep shown in FIG. 11 are identical to those of the turboexpander pump Ep shown in FIG. 7. The diameters of the outlet ports 116, 121 and outlet pipes connected thereto are selected as shown in FIG. 11 on the assumption that the liquid fluid flows at a higher rate to the heat exchanger, and should appropriately be determined depending on the actual proportions of flow rates.

The turboexpander pump unit which incorporates the turboexpander pump Ep shown in FIG. 11 can apply a higher pressure to the liquid fluid for delivering the liquid fluid over a long distance. The gas expanded and reduced in pressure by the expander turbine can be used as a combustible gas for heating the liquid fluid or a gas to be delivered to an external installation for generating electric energy or as a city gas, as with the embodiment shown in FIG. 7.

Figure 12:
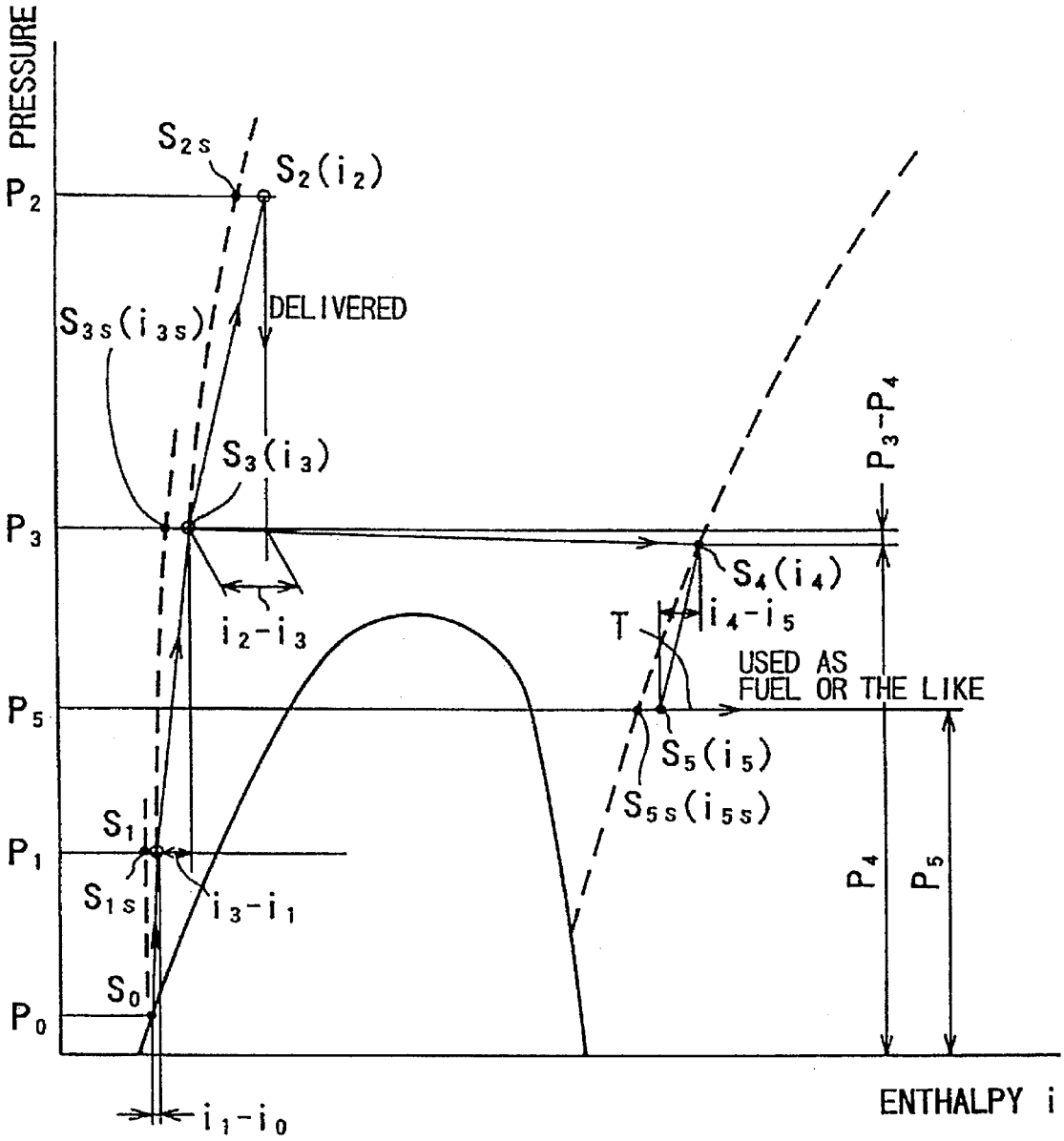
FIG. 12 is a pressure-enthalpy diagram illustrative of the principles of operation of the turboexpander pump shown in FIG. 11.

FIG. 12 is a pressure-enthalpy diagram illustrative of the principles of operation of the turboexpander pump Ep shown in FIG. 11.

Figure 10:
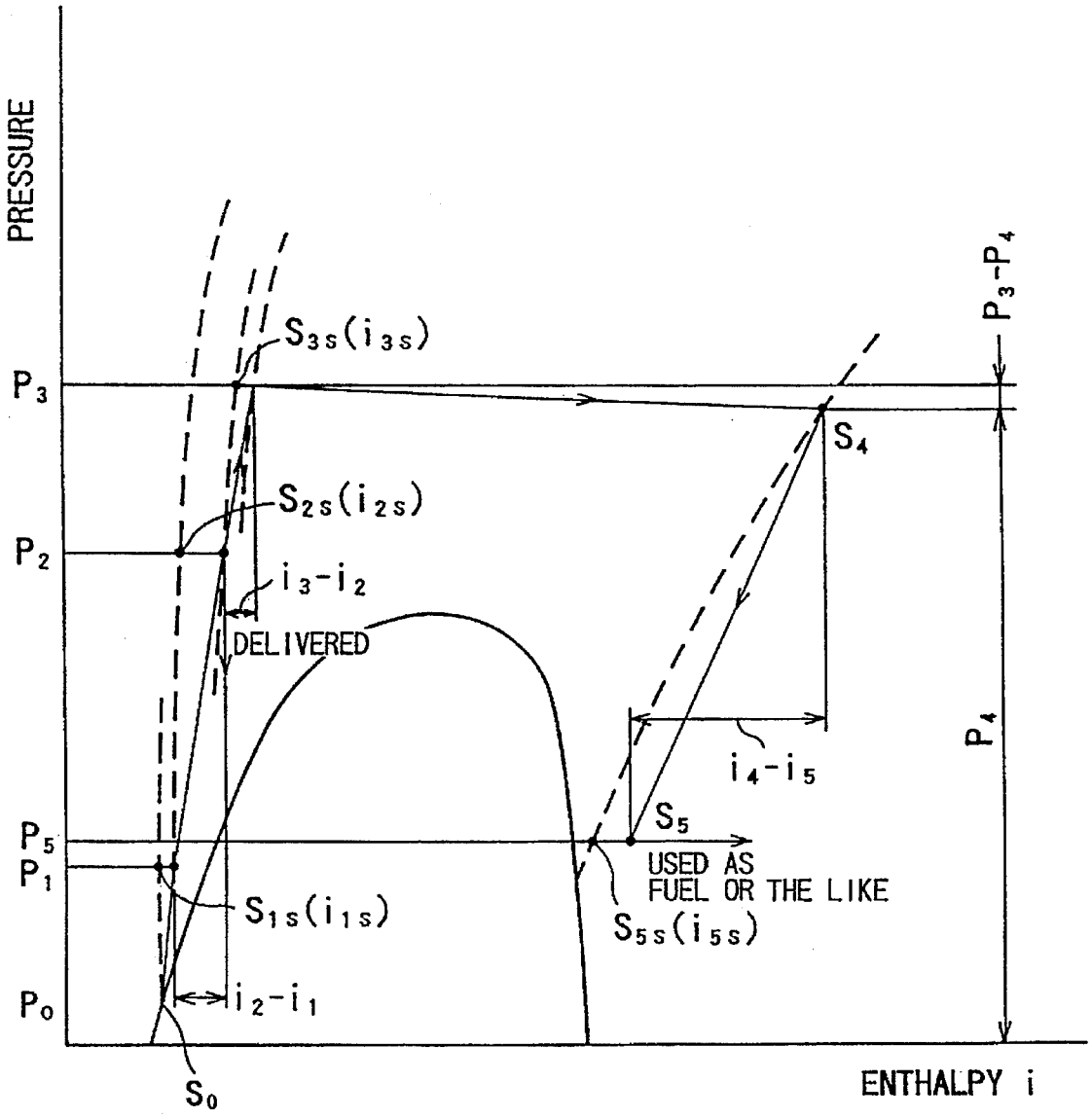
FIG. 10 is a pressure-enthalpy diagram illustrative of the principles of operation of the turboexpander pump units shown in FIGS. 8 and 9.

As with the principles of operation shown in FIG. 10, a liquid fluid at a low temperature, such as an LNG, liquid hydrogen, or the like is pressurized by the primary pump from a state $S_0$ under a pressure $P_0$ close to the atmospheric pressure up to a pressure $P_1$ at a state $S_1$. The liquid fluid is then polytropically pressurized, taking a loss into account, up to a pressure $P_3$ by the pump 101 which is a secondary pump. A portion w kg of the pressurized liquid fluid is delivered from the first outlet port 116 to the heat exchanger 132 or 138. The remaining liquid fluid (W−w) kg is further pressurized up to a pressure $P_2$ at a state $S_2$. The liquid fluid in the state $S_2$ is delivered to an external pipe line. The liquid fluid w kg extracted in the state $S_3$ is heated by the heat exchanger into a gas at a state $S_4$ in which its pressure is lower by a loss caused by the heat exchanger. From the state $S_4$, the gas is polytropically expanded into a state $S_5$ which is shifted a turbine loss along an entropy-constant curve. Subsequently, the gas goes to a state $S_6$ due to an isobaric change at the burner 135 in the combustion heater 132 (see FIG. 8), or is delivered as a gas having a pressure of $P_5$ to an external installation (see FIG. 9).

Therefore, such an operating arrangement is established as a system if the following relationship is satisfied:

$$W(i_3-i_1)+(W-w)(i_2-i_3)\leqq w(i_4-i_1),$$

i.e., $$w/W\geqq(i_2-i_1)/(i_4-i_5+i_2-i_3).$$

Establishment of such a system will be described quantitatively with respect to an example in which liquid hydrogen is employed.

Liquid hydrogen having a saturated pressure $P_0$=0.12 MPa at 21° K. and an enthalpy $i_0$=270 kJ/kg is to be combusted as a gas having a pressure $P_5$=0.5 MPa. First, the pressure of the liquid hydrogen is to be increased up to a pressure $P_1$=0.28 MPa by the primary pump, and then up to a pressure $P_3$=4 MPa by the secondary pump. An extracted portion of the liquid hydrogen is to be heated up to 500° K. by a heat exchanger (combustion heater) having a loss of 1.5 MPa. Thereafter, the heated liquid hydrogen is to be expanded into a gas having a pressure of 0.5 MPa by the expander turbine. If $P_1$=0.28 MPa, $i_{1S}$=272 kJ/kg, and the pump efficiency η=60%, then the state $S_1$ in an isentropy change has an enthalpy $i_1$ as follows:

$$i_1=(i_{1S}-i_0)/\eta p+i_0=(272-270)/0.60+270=273 \text{ kJ/kg}.$$

The state $S_3$ has a pressure $P_3$=4 MPa and an enthalpy $i_3$ as follows:

$$i_3=(i_{3S}-i_1)/\eta p+i_1=(326-273)/0.6+273=361 \text{ kJ/kg}.$$

The extracted portion of the liquid hydrogen is heated to a temperature T=500° K. at the state $S_4$, which has an enthalpy $i_4$=7120 kJ/kg. The liquid hydrogen has a pressure $P_2$=7.5 MPa in the state $S_2$, in which:

$$\begin{aligned} i_{2s} &= 410 \text{ kJ/kg}, \\ i_2 &= i_3+(i_{2s}-i_3)/\eta p=361+(410-361)/0.6 \\ &= 443 \text{ kJ/kg}. \end{aligned}$$

If the overall adiabatic efficiency ηe of the expander turbine is ηe=70%, then when the pressure of the liquid hydrogen is isentropically lowered to the pressure $P_5$=0.5 MPa, $$i_4-i_5=(_4-i_{5S})\times\eta e=(7120-4500)\times 0.7=1834 \text{ kJ/kg}.$$

Therefore, $$(i_2-i_1)/(i_4-i_5+i_2-i_3)=(443-273)/(1834+443-361)=0.088.$$

Consequently, it can be seen that the pump according to the embodiment shown in FIG. 11 can sufficiently be actuated.

Figure 13:
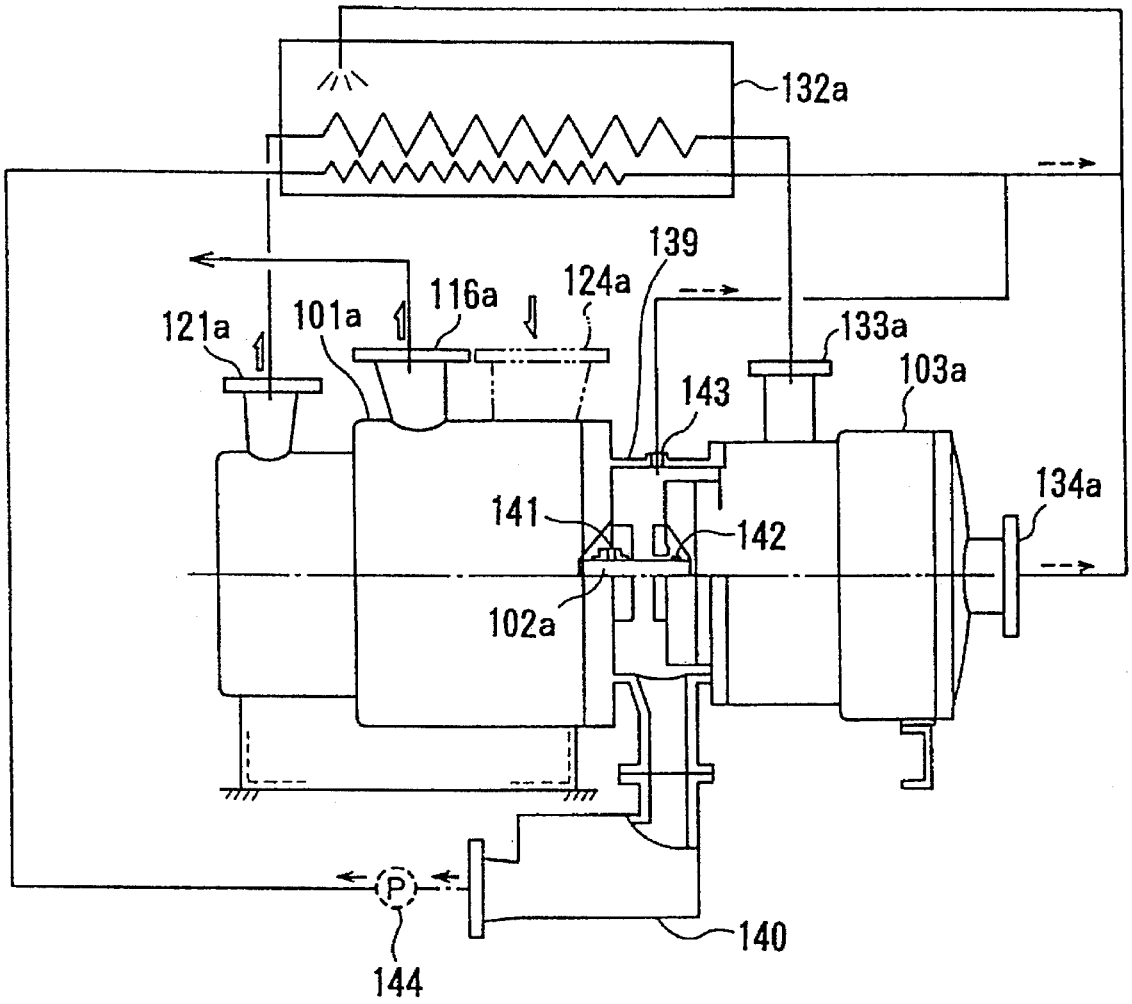
FIG. 13 is an elevational view of still another turboexpander pump unit which incorporates the turboexpander pump shown in FIG. 7.

FIG. 13 shows still another turboexpander pump unit which incorporates the turboexpander pump shown in FIG. 7. In FIG. 13, the turboexpander pump has a horizontal shaft 102*a*, a pump 101*a* mounted on one end of the shaft 102*a*, and an expander turbine 103*a* mounted on the other end of the shaft 102*a*. The pump 101*a* and the expander turbine 103*a* are connected to each other by a joint barrel 139 having an opening 143 defined in an upper wall thereof. A drain recovery casing 140 is attached to a lower wall of the joint barrel 139. A non-contact labyrinth seal 142 is disposed around the shaft 102*a* in the expander turbine 103*a*. The pump 101*a* and the turbine 103*a* are structurally identical to those shown in FIGS. 7 and 11 except that the pump 101*a* and the turbine 103*a* have the horizontal shaft 102*a*.

Operation of the turboexpander pump unit shown in FIG. 13, including fluid flows, and advantages offered thereby are basically the same as those of the turboexpander pump units according to the previous embodiments.

The pressure in the joint barrel 139 is basically equal to and slightly higher than the delivery pressure of the gas in the state $S_5$ from the expander turbine 103*a*. Any gas leakage from the expander turbine 103*a* into the joint barrel 139 flows through the non-contact labyrinth seal 142. A certain differential pressure equal to the head or pressure drop across the expander turbine 103*a* is developed between the interior of the expander turbine 103*a* and the interior of the joint barrel 139. There is basically no or slight differential pressure in the region of the pump 101*a* through which the shaft 102*a* extends. The liquid is prevented from leaking from that region of the pump 101*a* by a non-contact shaft seal similar to a mechanical seal, or a floating ring or the like, which allows a certain amount of liquid to leak. Such a seal mechanism permits the turboexpander pump to have a desired service life as an industrial machine.

Inasmuch as the pressure in the joint barrel 139 is basically the same as the delivery pressure of the gas in the state $S_5$ from the expander turbine 103*a*, any gas leaking from the expander turbine 103*a* and a gas produced when the liquid leaks from the pump 101*a* can be introduced from the opening 143 into a gas delivery line connected to the outlet port 134 of the expander turbine 103*a*. Any liquid leaking from the pump 101*a* is recovered from the joint barrel 139 into the drain recovery casing 140, and introduced into a combustion heater 132*a* by a small-size recovery pump 144. The combustion heater 132*a* converts the liquid into a gas, and introduces the gas into a delivery line.

In FIG. 13, the combustion heater 132*a* may be replaced with a warming heater, or a second outlet port 121*a* may be connected to a liquid delivery line to deliver a high-pressure liquid to an external installation.

Since the pump has two outlet ports in the embodiments shown in FIGS. 7, 11, and 13, the pressurized liquid discharged from one of the outlet ports can be converted into a gas by a heat exchange for actuating the expander turbine 103 or 103*a*, and the liquid can be delivered under pressure from the other outlet port. Therefore, each of the arrangements shown in FIGS. 7, 11, and 13 can be used in a wider selection of applications than the arrangement shown in FIG. 1.

Figure 14:
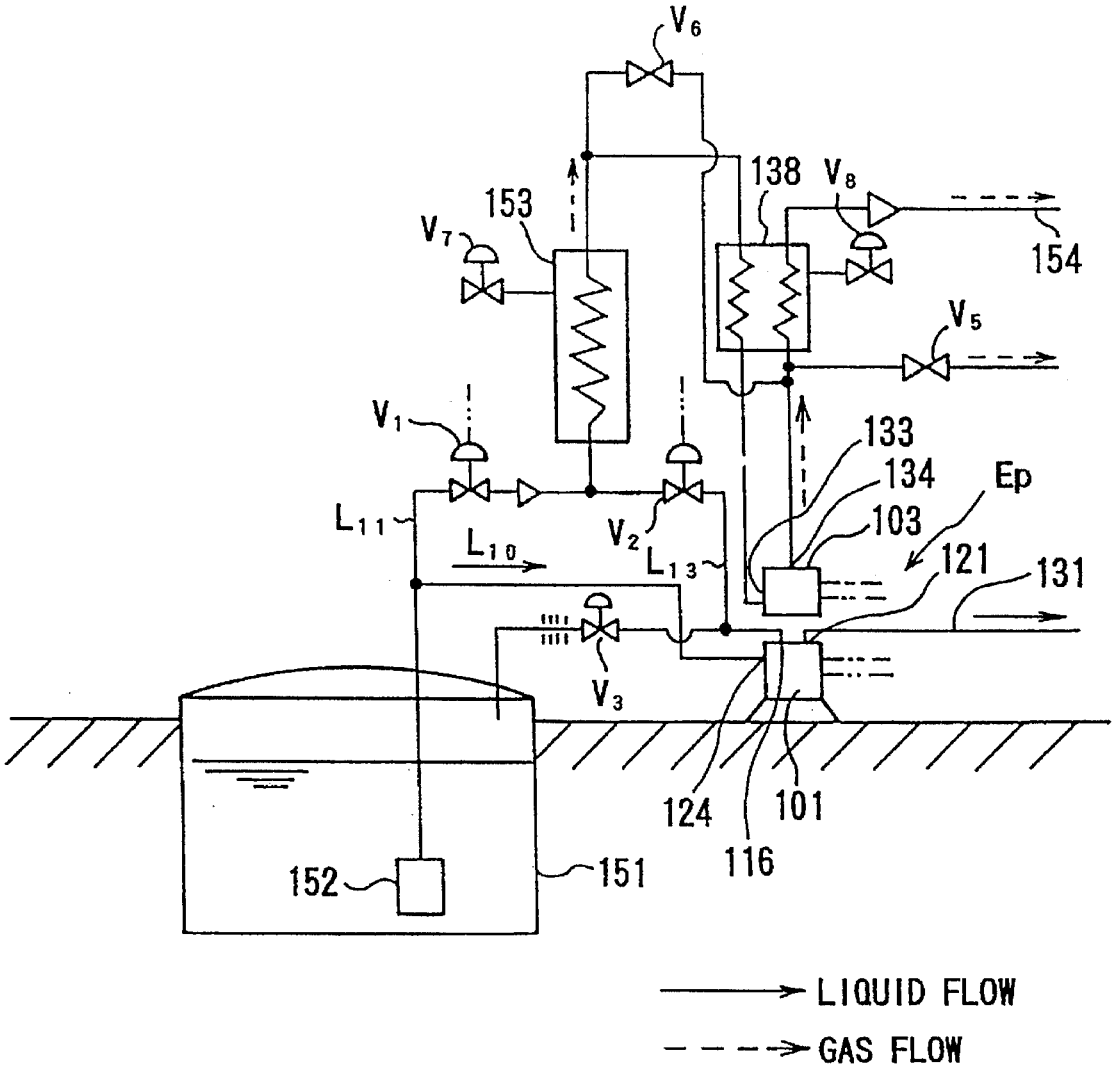
FIG. 14 is a conceptual diagram of a liquefied gas supply installation which incorporates the turboexpander pump shown in FIG. 11.

FIG. 14 shows a liquefied gas supply installation which incorporates the turboexpander pump shown in FIG. 11. The liquefied gas supply installation shown in FIG. 14 will be described below primarily with respect to fluid flows and valve control in various stages in the liquefied gas supply installation. In FIG. 14, solid-line arrows represent liquid flows, and dotted-line arrows represent gas flows.

A liquefied gas (liquid) such as an LNG is stored in a partly underground tank 151. The LNG stored in the tank 151 can be lifted by a primary pump 152 immersed in the stored LNG. The primary pump 152 has an outlet port connected through a line $L_{10}$ to an inlet port 124 of a pump 101 of a secondary pump (turboexpander pump) Ep, and also through a line $L_{11}$ having a valve $V_1$ to an inlet port of an evaporator 153. The pump 101 has a first (low-pressure) outlet port 116 connected through a line $L_{13}$ having a valve $V_2$ to the evaporator 153 and a warming heater (heat exchanger) 138, and a second (high-pressure) outlet port 121 connected to a liquid delivery line 131, as with the turboexpander pump Ep shown in FIG. 11. Therefore, the pump 101 is characterized by a pressure-enthalpy diagram as shown in FIG. 12. The evaporator 153 has an outlet port connected through the warming heater 138 to a gas inlet port 133 of an expander turbine 103, which is combined with the pump 101, thus making up the secondary pump Ep. The expander turbine 103 has a gas outlet port 134 coupled through the warming heater 138 to a gas delivery pipe 154.

The first outlet port 116 of the pump 101 is also connected through a valve $V_3$ to the tank 151 for returning a portion of the discharged liquid from the pump 101 to the tank 151. The evaporator 153 is also connected through a bypass line having a valve $V_6$ to the gas outlet port 134 of the expander turbine 103 which is connected to the warming heater 138. When the expander turbine 103 is to be serviced for maintenance, the valve $V_6$ is opened to bypass the expander turbine 103 to send a gas to utilities in an LNG base. Valves $V_7$, $V_8$ are connected to the evaporator 153 and the warming heater 138, respectively, for delivering a heat medium to the evaporator 153 and the warming heater 138. The valves shown in FIG. 14 are controlled by a controller 136 shown in FIG. 15, and a rotational speed detector 137 for detecting the rotational speed of the shaft of the secondary pump Ep.

To start the liquefied gas supply installation shown in FIG. 14, the valve $V_1$ is opened to supply a liquid lifted by the primary pump 152 through the line $L_{11}$ and the evaporator 153 to the warming heater 138. The warming heater 138 heats and converts the liquid into a gas under a high pressure, and the gas is supplied to the turbine 103 through the gas inlet port 133. As the rotational speed of the turbine 103 increases gradually, the pressure for pressurizing the liquid in the pump 101 also increases gradually. The liquid discharged from the pump 101 flows through the valve $V_2$ in the line $L_{13}$ into the evaporator 153. The liquefied gas supply installation now enters a normal state of operation.

When the rotational speed of the secondary pump Ep increases to increase the pressure therein, a check valve disposed downstream of the valve $V_1$ is gradually closed, directs the entire amount W kg of liquid lifted by the primary pump 152 into the inlet port 124 of the pump 101. An amount w kg of the liquid thus supplied to the pump 101 is extracted as pressurized in a state $S_3$, and converted into a gas with heat by the evaporator 153 and the warming heater 138. The gas is then expanded in the expander turbine 103, rotating the pump 101, at which the pressure of the gas is slightly lowered. The gas is then delivered as a high-pressure gas from the gas delivery pipe 154 to an external installation. The remaining amount (W−w) kg of liquid is further pressurized by the pump 101, and delivered as a liquid in a state $S_2$ under a pressure $P_2$ into the liquid delivery line 131. In the warming heater 138, the gas discharged from the expander turbine 103 imparts heat to the gas supplied thereto.

When the pump 101 and the expander turbine 103 are shut off for maintenance or the like, the utilities including a boiler, a turbine, and so on in the LNG base need to be supplied with a fuel. While the pump 101 and the expander turbine 103 are being inactivated, the valve $V_2$ in the line $L_{13}$ is closed, and the valve $V_6$ in the bypass line is opened. The liquid lifted by the primary pump 152 can now be delivered through the valve $V_1$, the evaporator 153, and the valve $V_6$ to the warming heater 138 where it is converted into a gas, so that the fuel gas can be supplied through the gas delivery pipe 154 to the utilities.

Figure 15:
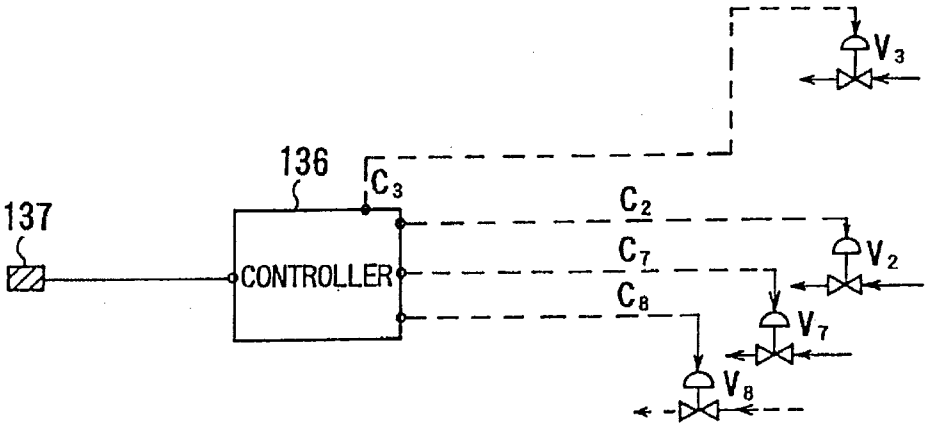
FIG. 15 is a diagram of a control system of the liquefied gas supply installation shown in FIG. 14.

FIG. 15 illustrates a control system of the liquefied gas supply installation shown in FIG. 14. The rotational speed of the shaft of the secondary pump Ep is detected by the rotational speed detector 137, and sent to the controller 136 for controlling the opening of the valves $V_2$, $V_7$, and so on. These valves are controlled when the liquefied gas supply installation is started, operates in a normal state, and is controlled in its rotational speed, as shown in Table in FIG. 15 where "0" represents opening of the valves and "C" closing of the valves. The rotational speed of the liquefied gas supply installation can be controlled by adjusting the valve $V_2$ to adjust the extracted quantity w kg of liquid, adjusting the opening of the valve $V_7$ which supplies a warming fluid such as seawater to the evaporator 153 to adjust the amount of applied heat ($i_3 \rightarrow i_4$), or adjusting the valve $V_8$ which supplies waste heat from the evaporator 153 to adjust the amount of applied heat ($i_3 \rightarrow i_4$) (see FIG. 12).

Figure 16:
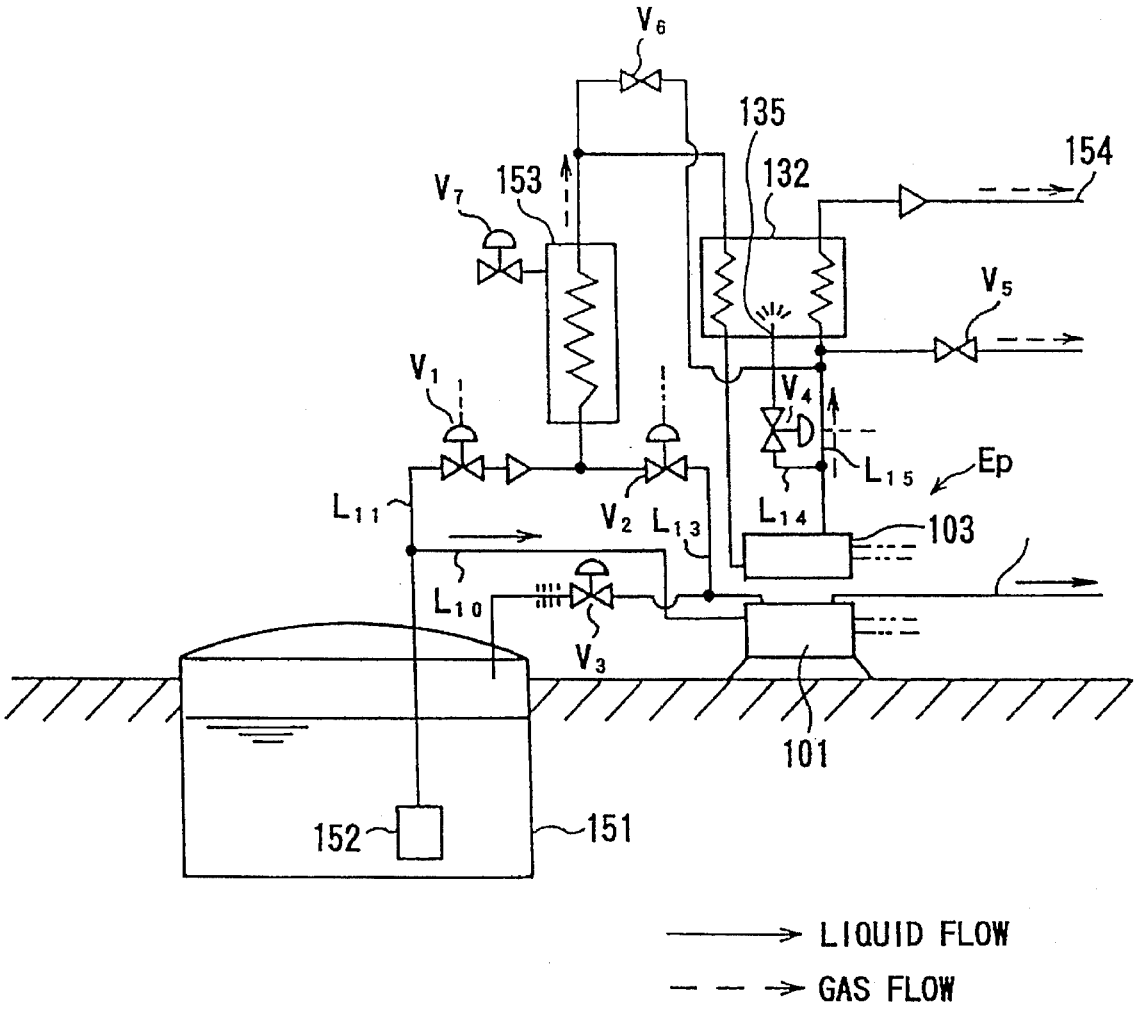
FIG. 16 is a conceptual diagram of another liquefied gas supply installation which incorporates the turboexpander pump shown in FIG. 11.

FIG. 16 shows another liquefied gas supply installation which incorporates the turboexpander pump shown in FIG. 11. The liquefied gas supply installation shown in FIG. 16 is basically the same as the liquefied gas supply installation shown in FIG. 14 except that the warming heater 138 shown in FIG. 14 is replaced with a combustion heater (heat exchanger) 132 for burning a portion of gas discharged from the expander turbine 103 to positively heat a gas to be supplied to the expander turbine 103. The combustion heater 132 has a burner 135 connected to a pipe $L_{15}$ having a valve $V_4$ and branched off from a pipe $L_{15}$ which is connected to the gas outlet port 134 of the expander turbine 103. Therefore, the gas supplied to the expander turbine 103 can be positively heated to a higher temperature and a higher pressure by the combustion heater 132 for increasing the drive power of the expander turbine 103, i.e., the output power of the pump 101. Provided the output power of the pump 101 is constant, the turbine 103 and the pump 101 may be reduced in size. After the gas has done its work in the expander turbine 103, its pressure is lowered, and a portion of the gas is burned in the combustion heater 132. Therefore, the turboexpander pump unit shown in FIG. 16 is of a self-contained configuration.

Figure 17:
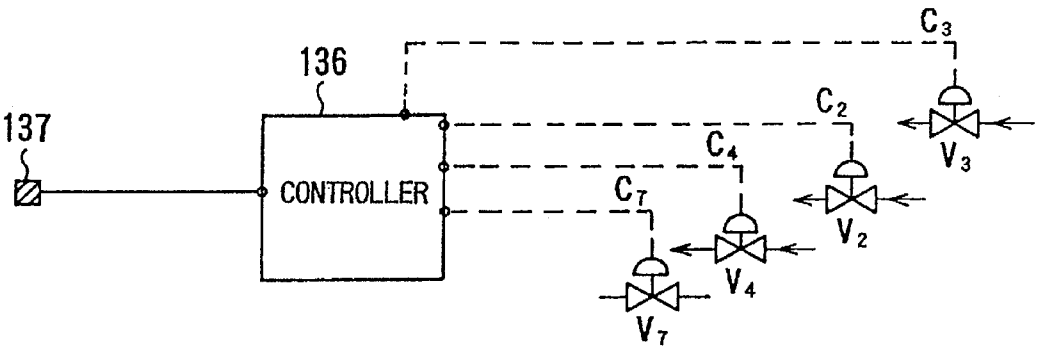
FIG. 17 is a diagram of a control system of the liquefied gas supply installation shown in FIG. 16.

Fluid flows at the time the liquefied gas supply installation is started, operates in a normal state, and is controlled in its rotational speed are essentially the same as those shown in FIG. 14. FIG. 17 shows a control system of the liquefied gas supply installation shown in FIG. 16. In the embodiment shown in FIG. 16, adjustments of the valve $V_4$ for adjusting the flow of the gas supplied to the burner 135 of the combustion heater 132 are greatly involved in adjustments of the amount of heat applied to the gas to be supplied to the expander turbine 103, and play an important role in adjusting the output power of the turboexpander pump Ep.

In the above embodiments, the liquid pressurized into the state $S_2$ by the secondary pump Ep is delivered under pressure to an external installation. However, the pressurized liquid may be converted into a gas by an evaporator, and the gas may be delivered under pressure to an external installation. Furthermore, the liquid discharged from the second outlet port, rather than the first outlet port, of the pump of the secondary pump Ep may be converted into a gas for driving the expander turbine.

The above liquefied gas supply installations do not require the supply of electric energy or another fuel from an external source for driving the pump to delivery a liquefied gas under pressure. Therefore, it is possible to realize a system of reduced energy loss which needs no equipment for transmitting and distributing electric energy. Consequently, the liquefied gas supply installations may be reduced in size, allowing liquefied gas supply bases to be installed in a smaller area for clean and sightly environments.

A turboexpander pump according to a still further embodiment of the present invention will be described below with reference to FIG. 18. The turboexpander pump shown in FIG. 18 has an improved support base for supporting the expander turbine and an improved joint barrel for covering the shaft thereof. The other details of the turboexpander pump are the same as those of the turboexpander pumps shown in FIGS. 7 and 11, and will not be described below.

Figure 18:
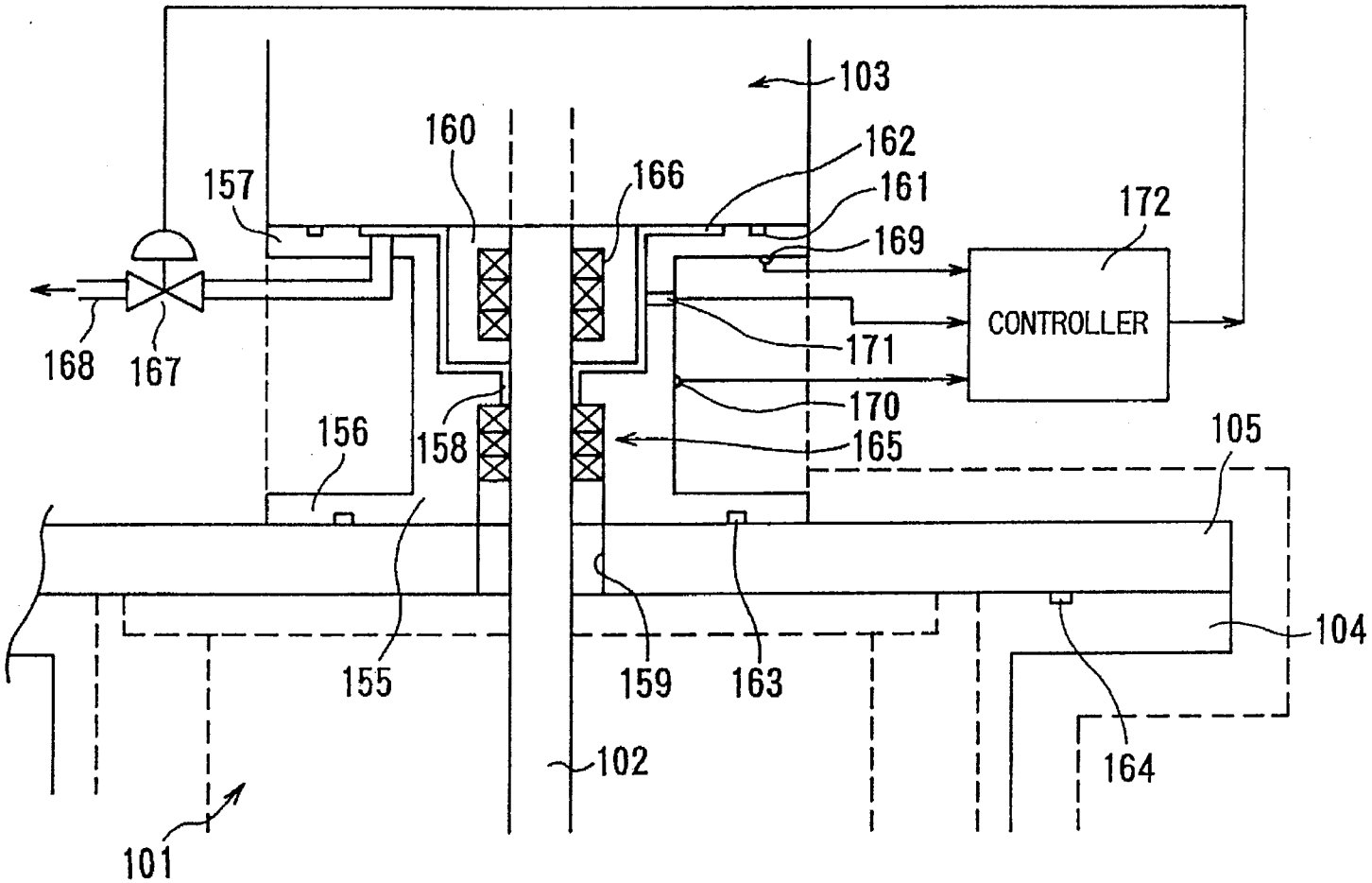
FIG. 18 is a schematic view of a turboexpander pump according to a still further embodiment of the present invention.
Figure 19:
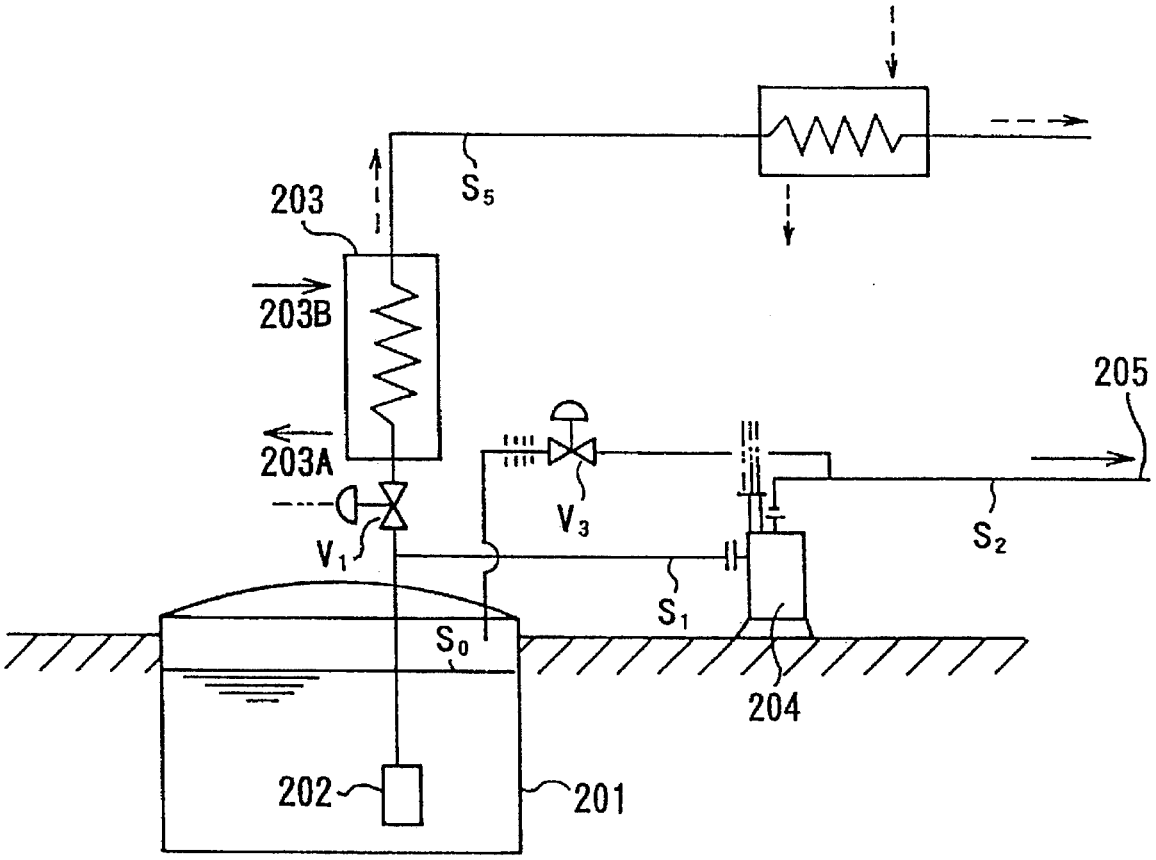
FIG. 19 is a conceptual diagram of a conventional liquefied gas supply installation.

As shown in FIG. 18, an expander turbine 103 is fixedly mounted on a prime mover base 155 that is placed on a cover 105 of a barrel 104 which houses a pump 101. The prime mover base 155 is of a cylindrical shape and has lower and upper flanges 156, 157 spaced vertically from each other. The prime mover base 155 has a central through hole 158 extending vertically which is large enough to allow a shaft 102 to extend therethrough. The hole 158 has a wider lower portion in registration with an opening 159 defined in the cover 105, and an even wider upper portion large enough to permit a protrusion 160 of the expander turbine 103 to be inserted therein.

The expander turbine 103 is fixed to the upper flange 157 of the prime mover base 155 through a seal 161 interposed therebetween. The protrusion 160 of the expander turbine 103 is placed in the wider upper portion of the hole 158 in the prime mover base 155 with a clearance 162 left around the protrusion 160. The lower flange 156 of the prime mover base 155 is fixed to the cover 105 through a seal 163 interposed therebetween. The shaft 102 extends through the opening 159 which is defined centrally in the cover 105. A seal 164 is interposed between the barrel 104 and the cover 105.

The shaft 102 extends from the expander turbine 103 through the hole 158 in the prime mover base 155 and the opening 159 in the cover 105 into the pump 101. The shaft 102 is supported out of contact with the surrounding components by magnetic bearings or the like. A limit seal 165 is disposed in a gap between the prime mover base 155 and the shaft 102 in a power portion of the prime mover base 155 for minimizing a gas leakage along the shaft 102. Another limit seal 166 is disposed between the protrusion 160 and the shaft 102 for minimizing a gas leakage along the shaft 102. The prime mover base 155 and the pump 101 have outer peripheral walls of heat insulating structure.

A gas discharge pipe 168 having a control valve 167 for adjusting the pressure of a gas flowing therethrough communicates with the clearance 162. Temperature sensors 169, 170 are disposed respectively on the upper flange 157 of the prime mover base 155 and an outer wall of the prime mover base 155, and a pressure sensor 171 is disposed in the outer wall of the prime mover base 155 for detecting the pressure of a gas in the clearance 162. Output signals from the temperature sensors 169, 170 and the pressure sensor 171 are applied to a controller 172, which controls the control valve 167 to adjust the pressure of a gas in the clearance 162.

A liquid fluid flowing through the pump 101 passes along the shaft 102 and from the opening 159 in the cover 105 through the limit seal 165 into the clearance 162. The clearance 162 is filled with a gas which is evaporated from the liquid fluid with heat from the expander turbine 103. The gas is combined with a gas flowing from the expander turbine 103 through the limit seal 166. In this manner, the pressures from the pump 101 and the expander turbine 103 are balanced.

When the pressure of the gas in the clearance 162 is increased by the heat transferred from the expander turbine 103, the controller 172 processes output signals from the temperature sensors 169, 170 and the pressure sensor 171 to detect the increase in the gas pressure, and controls the control valve 167 to discharge the gas from the gas discharge pipe 168 until the gas pressure in the clearance 162 is adjusted to a predetermined value, for thereby preventing the gas from flowing back into the pump 101.

With the turboexpander pump shown in FIG. 18, since the prime mover base 155 for securing the expander turbine 103 as a prime mover and a pressure vessel which covers the shaft 102, are integrally formed with each other, it is not necessary to employ bellows capable of absorbing shaft displacements or strains due to temperature differences. The liquid fluid always leaks from the pump 101 along the shaft 102 into the gap around the shaft 102, and is evaporated into a gas by the heat from the expander turbine 103 for thereby developing a gas pressure which counterbalances the gas pressure in the expander turbine 103. When the gas pressure in the gap around the shaft 102 is increased by the heat transferred from the expander turbine 103, the controller 172 processes output signals from the temperature sensors 169, 170 and the pressure sensor 171, and controls the pressure adjusting means, i.e., the control valve 167, to adjust the gas pressure in the gap around the shaft 102 to a predetermined value. Therefore, the gas in the gap around the shaft 102 is prevented from flowing back into the pump 101, which is allowed to operate stably.

The above structure of the prime mover base 155 can be used with respect to a prime mover other than the expander turbine 103 for driving the pump 101.

Although certain preferred embodiments of the present invention has been shown and described in detail, it should be understood that various changes and modifications may be made therein without departing from the scope of the appended claims.

What is claimed is:

1. A liquified gas supply installation comprising:

a liquified gas storage tank;

a first-stage pump disposed in said liquified gas storage tank having a pressurized liquid outlet port, said first-stage pump being self-startable;

a second-stage pump unit in communication with said outlet port of said first-stage pump, said second-stage pump unit for discharging a continuous flow of the liquid under a predetermined pressure; and piping connected to said outlet port of the second-stage pump unit for delivering the liquid discharged from said second-stage pump unit;

wherein said second-stage pump unit comprises:

a shaft having a first end and a second end;

a pump section connected to said first end of said shaft, said pump section for pressurizing said liquid and discharging pressurized liquid through a first pump section outlet port;

a heat exchanger communicating with the first pump section outlet port, the heat exchanger for heating and converting at least a portion of the liquid pressurized from said pump section outlet into a high-pressure gas discharging through a heat exchanger outlet port; and an expander turbine connected to said second end of said shaft and in communication with said heat exchanger outlet port, said expander turbine driven by expanding and reducing pressure of the high-pressure gas from said heat exchanger and having a discharge port for reduced pressure gas.

2. A liquified gas supply installation according to claim 1, wherein said heat exchanger comprises a burner for heating said liquid and piping for supplying at least a portion of gas discharged from a discharge port of said expander turbine as a fuel to said burner.

3. A liquified gas supply installation according to claim 1, wherein said pump section includes a second outlet port for discharging the liquid at pressure different from the pressure of the liquid from the first outlet port of the pump section, said second outlet port being connected to a liquid delivery line.

4. A liquified gas supply installation according to claim 1, wherein said second-stage pump unit further comprises a magnetic bearing, said shaft being supported by said magnetic bearing.

5. A liquified gas supply installation according to claim 1, wherein said expander turbine has a non-contact shaft seal disposed around said shaft in a region in which said shaft extends into the expander turbine.

6. A liquified gas supply installation according to claim 1, wherein said pump section and said expander turbine are spaced apart from each other so as to prevent a heat transfer therebetween.

7. A liquified gas supply installation according to claim 1, wherein said pump section includes a plurality of impellers, said impellers including a first-stage impeller having an inlet port positioned closer to said expander turbine than the first stage impeller.

8. A liquified gas supply installation according to claim 1, wherein said pump section has a plurality of impellers, said impellers including a first impeller group for delivering the liquid fluid in a first direction and a second impeller group for delivering the liquid fluid in a second direction which is opposite to said first direction, said first impeller group containing as many impellers as contained in said second impeller group.

9. A liquified gas supply installation according to claim 1, wherein said pump section has a plurality of impellers, said impellers including a primary impeller group for pressurizing the liquid fluid in a first direction and a secondary impeller group for pressurizing the liquid fluid in a second direction opposite from said first direction, said primary impeller group being disposed above said secondary impeller group, said impeller group having an outlet port and said secondary impeller group having an inlet port, said pump section further having a flow passage interconnecting said outlet port of the primary impeller group and said inlet port of the secondary impeller group.

10. A liquified gas supply installation according to claim 1, wherein said heat exchanger heats said liquid by heat exchange with an ordinary temperature heat source fluid medium.

11. A liquified gas supply installation according to claim 10, wherein said ordinary temperature heat source fluid medium includes sea water.

12. A liquified gas supply installation according to claim 1, further comprising a joint pipe disposed hermetically around a portion of said shaft which extends between said pump section and said expander turbine, said pump section and said expander turbine having respective casings which are held in communication with each other by said joint pipe.

13. A liquified gas supply installation according to claim 12, wherein said joint pipe includes means for absorbing longitudinal thermal strains.

14. A liquified gas supply installation according to claim 12, wherein pressures exerted in said joint pipe from said pump section and said expander turbine are substantially equal to each other.

15. A liquified gas supply installation according to claim 14, wherein said pump section has a non-contact shaft seal disposed around said shaft in a region in which said shaft extends into the pump section to allow the liquid to leak to a limited extent along said shaft.

16. A liquified gas supply installation according to claim 12, further comprising a line extending outwardly from said joint pipe for adjusting a pressure in said joint pipe.

17. A liquified gas supply installation according to claim 12, further comprising a support base supporting said expander turbine above said pump section, said joint pipe being integrally joined to said support base.

* * * * *